US010480308B2

(12) United States Patent
Morrow et al.

(10) Patent No.: US 10,480,308 B2
(45) Date of Patent: Nov. 19, 2019

(54) APPARATUS AND METHOD FOR MONITORING FLUID FLOW IN A WELLBORE USING ACOUSTIC SIGNALS

(71) Applicants: Timothy I. Morrow, Humble, TX (US); Stuart R. Keller, Houston, TX (US); Max Deffenbaugh, Fulshear, TX (US); Mark M. Disko, Glen Gardner, NJ (US); David A. Stiles, Spring, TX (US)

(72) Inventors: Timothy I. Morrow, Humble, TX (US); Stuart R. Keller, Houston, TX (US); Max Deffenbaugh, Fulshear, TX (US); Mark M. Disko, Glen Gardner, NJ (US); David A. Stiles, Spring, TX (US); Scott W. Clawson, Califon, NJ (US); H. Alan Wolf, Morris Plains, NJ (US); Katie M. Walker, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 419 days.

(21) Appl. No.: 14/434,732

(22) PCT Filed: Dec. 18, 2013

(86) PCT No.: PCT/US2013/076282
§ 371 (c)(1),
(2) Date: Apr. 9, 2015

(87) PCT Pub. No.: WO2014/100272
PCT Pub. Date: Jun. 26, 2014

(65) Prior Publication Data

US 2015/0354351 A1 Dec. 10, 2015

Related U.S. Application Data

(60) Provisional application No. 61/739,679, filed on Dec. 19, 2012.

(51) Int. Cl.
*E21B 47/12* (2012.01)
*E21B 47/14* (2006.01)
(Continued)

(52) U.S. Cl.
CPC ..... *E21B 47/01* (2013.01); *E21B 47/10* (2013.01); *E21B 47/12* (2013.01); *E21B 47/14* (2013.01);
(Continued)

(58) Field of Classification Search
None
See application file for complete search history.

(56) References Cited

U.S. PATENT DOCUMENTS 3,103,643 A * 9/1963 Kalbfell ..... E21B 47/16 367/140
3,512,407 A * 5/1970 Zill ..... E21B 47/00 340/854.9
(Continued)

FOREIGN PATENT DOCUMENTS

EP 0 636 763 2/1995
EP 1 409 839 4/2005
(Continued)

OTHER PUBLICATIONS

Emerson Process Management (2011), "Roxar downhole Wireless PT sensor system," www.roxar.com, or download@roxar.com, 2 pgs.

*Primary Examiner* — Steven Lim
*Assistant Examiner* — Muhammad Adnan
(74) *Attorney, Agent, or Firm* — ExxonMobil Upstream Research Company—Law Department

(57) ABSTRACT

An electro-acoustic system for downhole telemetry employs a series of communications nodes spaced along a string of casing within a wellbore. The nodes allow wireless com-
(Continued)

munication between transceivers residing within the nodes and a receiver at the surface. The transceivers provide node-to-node communication up a wellbore at high data transmission rates for data indicative of fluid flow within the wellbore. A method of monitoring the flow of fluid within a wellbore uses a plurality of data transmission nodes situated along the casing string sending signals to a receiver at the surface. The signals are then analyzed.

46 Claims, 8 Drawing Sheets

(51) Int. Cl.

| | |
|---|---|
| ***E21B 49/00*** | (2006.01) |
| ***E21B 49/08*** | (2006.01) |
| ***E21B 47/01*** | (2012.01) |
| ***E21B 47/10*** | (2012.01) |
| ***E21B 47/16*** | (2006.01) |

(52) U.S. Cl.
CPC ..... *E21B 47/16* (2013.01); *E21B 49/00* (2013.01); *E21B 49/08* (2013.01)

(56) References Cited

U.S. PATENT DOCUMENTS 3,781,783 A * 12/1973 Tucker ..... G01V 1/44 340/854.1
4,283,780 A * 8/1981 Nardi ..... E21B 47/12 310/322
4,302,826 A * 11/1981 Kent ..... E21B 47/12 175/40
4,314,365 A * 2/1982 Petersen ..... E21B 47/16 175/56
4,884,071 A 11/1989 Howard
5,128,901 A 7/1992 Drumheller
5,234,055 A 8/1993 Cornette
5,373,481 A * 12/1994 Orban ..... E21B 47/16 340/854.4
5,468,025 A * 11/1995 Adinolfe ..... F16L 47/12 285/114
5,480,201 A * 1/1996 Mercer ..... B66C 1/30 294/111
5,495,230 A 2/1996 Lian
5,562,240 A 10/1996 Campbell
5,592,438 A 1/1997 Rorden et al.
5,697,650 A * 12/1997 Brown ..... F16L 41/12 285/197
5,850,369 A 12/1998 Rorden et al.
5,857,146 A * 1/1999 Kido ..... H04W 52/0229 340/7.34
5,924,499 A * 7/1999 Birchak ..... E21B 47/14 175/40
5,995,449 A 11/1999 Green et al.
6,049,508 A 4/2000 Deflandre
6,125,080 A * 9/2000 Sonnenschein ..... B63C 11/02 367/134
6,177,882 B1 * 1/2001 Ringgenberg ..... E21B 47/122 324/342
6,236,850 B1 * 5/2001 Desai ..... G08C 17/02 340/10.1
6,239,690 B1 * 5/2001 Burbidge ..... H04W 52/0212 340/10.33
6,300,743 B1 * 10/2001 Patino ..... H02J 7/00 320/106
6,400,646 B1 * 6/2002 Shah ..... E21B 47/16 367/79
6,429,784 B1 * 8/2002 Beique ..... E21B 17/14 166/250.07
6,462,672 B1 10/2002 Besson
6,670,880 B1 12/2003 Hall et al.
6,695,277 B1 2/2004 Gallis
6,717,501 B2 4/2004 Hall et al.
6,727,827 B1 * 4/2004 Edwards ..... E21B 47/122 324/339
6,816,082 B1 11/2004 Laborde
6,868,037 B2 3/2005 Dasgupta et al.
6,899,178 B2 5/2005 Tubel
6,912,177 B2 6/2005 Smith
6,956,791 B2 10/2005 Dopf et al.
6,980,929 B2 12/2005 Aronstam et al.
6,987,463 B2 1/2006 Beique et al.
7,006,918 B2 2/2006 Economides et al.
7,064,676 B2 6/2006 Hall et al.
7,082,993 B2 8/2006 Ayoub et al.
7,140,434 B2 11/2006 Chouzenoux et al.
7,224,288 B2 5/2007 Hall et al.
7,249,636 B2 7/2007 Ohmer
7,257,050 B2 8/2007 Stewart et al.
7,277,026 B2 10/2007 Hall et al.
7,310,286 B1 * 12/2007 Jarvis ..... H04B 13/02 340/850
RE40,032 E * 1/2008 van Bokhorst ... H04W 52/0216 370/311
7,317,990 B2 1/2008 Sinha et al.
7,321,788 B2 * 1/2008 Addy ..... H04L 7/08 340/10.33
7,348,893 B2 3/2008 Huang et al.
7,411,517 B2 8/2008 Flanagan
7,477,160 B2 1/2009 Lemenager et al.
7,516,792 B2 4/2009 Lonnes et al.
7,595,737 B2 9/2009 Fink et al.
7,602,668 B2 10/2009 Liang et al.
7,649,473 B2 1/2010 Johnson et al.
7,775,279 B2 8/2010 Marya et al.
7,994,932 B2 * 8/2011 Huang ..... E21B 47/182 340/853.4
8,044,821 B2 10/2011 Mehta
8,049,506 B2 11/2011 Lazarev
8,115,651 B2 2/2012 Camwell et al.
8,162,050 B2 4/2012 Roddy et al.
8,220,542 B2 7/2012 Whitsitt et al.
8,237,585 B2 8/2012 Zimmerman
8,242,928 B2 8/2012 Prammer
8,330,617 B2 12/2012 Chen et al.
8,347,982 B2 1/2013 Hannegan et al.
8,381,822 B2 2/2013 Hales et al.
8,434,354 B2 5/2013 Crow et al.
8,496,055 B2 7/2013 Mootoo et al.
8,539,890 B2 9/2013 Tripp et al.
8,544,564 B2 10/2013 Moore et al.
8,787,840 B2 * 7/2014 Srinivasan ..... H04W 52/0245 370/216
8,826,980 B2 9/2014 Neer
8,833,469 B2 9/2014 Purkis
2002/0026958 A1 3/2002 Brisco
2002/0043369 A1 * 4/2002 Vinegar ..... E21B 17/003 166/250.07
2002/0153996 A1 * 10/2002 Chan ..... G01S 5/0009 340/10.4
2003/0056953 A1 3/2003 Tumlin et al.
2003/0117896 A1 * 6/2003 Sakuma ..... H04B 11/00 367/81
2003/0151977 A1 * 8/2003 Shah ..... E21B 47/122 367/82
2004/0065443 A1 4/2004 Berg et al.
2004/0073370 A1 4/2004 Dasgupta et al.
2004/0084190 A1 5/2004 Hill et al.
2004/0105342 A1 6/2004 Gardner et al.
2004/0124994 A1 * 7/2004 Oppelt ..... E21B 47/12 340/853.1
2004/0256113 A1 12/2004 LoGiudice et al.
2004/0262008 A1 * 12/2004 Deans ..... E21B 41/0007 166/339
2005/0024231 A1 2/2005 Fincher et al.
2005/0039912 A1 2/2005 Hall et al.
2005/0145010 A1 7/2005 Vanderveen et al.
2005/0284659 A1 12/2005 Hall et al.
2006/0002232 A1 1/2006 Shah et al.

(56) References Cited

U.S. PATENT DOCUMENTS

2006/0085552 A1* 4/2006 Sollenberger ..... H04W 52/0216 709/232
2006/0115095 A1* 6/2006 Giesbrecht ..... H04M 9/08 381/66
2006/0124310 A1 6/2006 Lopez de Cardenas et al.
2006/0133203 A1 6/2006 James et al.
2007/0024464 A1 2/2007 Lemenager et al.
2007/0029112 A1 2/2007 Li et al.
2007/0030762 A1 2/2007 Huang et al.
2007/0103271 A1* 5/2007 King ..... B60R 25/403 340/5.72
2007/0139217 A1 6/2007 Beique et al.
2007/0146351 A1* 6/2007 Katsurahira ..... G06F 3/03545 345/179
2007/0263488 A1* 11/2007 Clark ..... E21B 47/12 367/87
2008/0253228 A1* 10/2008 Camwell ..... E21B 47/12 367/82
2009/0045974 A1 2/2009 Patel
2009/0080291 A1* 3/2009 Tubel ..... E21B 47/122 367/81
2009/0159272 A1 6/2009 Auzerias et al.
2009/0264956 A1 10/2009 Rise et al.
2009/0277688 A1 11/2009 Oothoudt
2009/0289808 A1 11/2009 Prammer
2010/0013663 A1 1/2010 Cavender et al.
2010/0032210 A1* 2/2010 Teodorescu ..... E21B 47/011 175/40
2010/0126718 A1 5/2010 Lilley
2010/0157739 A1 6/2010 Slocum et al.
2010/0176813 A1 7/2010 Simon
2010/0194584 A1 8/2010 Savage
2010/0214107 A1* 8/2010 Montebovi ..... H02J 7/0042 340/636.1
2011/0066378 A1 3/2011 Lerche et al.
2011/0168403 A1 7/2011 Patel
2011/0186290 A1* 8/2011 Roddy ..... E21B 43/25 166/253.1
2011/0275313 A1* 11/2011 Baldemair ..... H04B 7/15542 455/17
2011/0280294 A1* 11/2011 Luo ..... H04L 25/0204 375/224
2011/0297376 A1 12/2011 Holderman et al.
2012/0017673 A1 1/2012 Godager
2012/0024050 A1 2/2012 Godagar
2012/0024052 A1 2/2012 Eriksen
2012/0043079 A1 2/2012 Wassouf et al.
2012/0076212 A1* 3/2012 Zeppetelle ..... H04B 3/54 375/259
2012/0090687 A1 4/2012 Grisby et al.
2012/0099550 A1* 4/2012 Jia ..... H04W 76/021 370/329
2012/0170410 A1 7/2012 Hay
2012/0179377 A1* 7/2012 Lie ..... E21B 47/101 702/6
2012/0241172 A1 9/2012 Ludwig et al.
2012/0256415 A1 10/2012 Dole
2012/0256492 A1 10/2012 Song et al.
2012/0257475 A1 10/2012 Luscombe et al.
2013/0003503 A1* 1/2013 L'Her ..... G01V 1/3817 367/106
2013/0008648 A1 1/2013 Lovorn et al.
2013/0106615 A1* 5/2013 Prammer ..... G01V 3/30 340/854.6
2013/0110402 A1 5/2013 Godager
2013/0118315 A1* 5/2013 Barnett ..... B25B 17/00 81/57.16
2013/0175094 A1 7/2013 Ross et al.
2013/0248172 A1 9/2013 Angeles Boza et al.
2013/0248174 A1 9/2013 Dale et al.
2013/0272708 A1* 10/2013 Mizuguchi ..... H04B 10/27 398/71
2013/0294203 A1* 11/2013 Goodman ..... H04R 31/00 367/164
2014/0079242 A1* 3/2014 Nguyen ..... H04R 5/00 381/86
2014/0152659 A1 6/2014 Davidson et al.
2014/0266769 A1 9/2014 van Zelm
2014/0269188 A1* 9/2014 van Zelm ..... E21B 47/12 367/81
2014/0327552 A1 11/2014 Filas et al.
2014/0352955 A1 12/2014 Tubel et al.
2015/0003202 A1* 1/2015 Palmer ..... E21B 47/16 367/82
2015/0009040 A1 1/2015 Bowles et al.
2015/0015413 A1* 1/2015 Gao ..... E21B 47/16 340/854.4
2015/0027687 A1 1/2015 Tubel
2015/0285065 A1* 10/2015 Howell ..... E21B 47/0005 367/82

FOREIGN PATENT DOCUMENTS

WO WO 2010/074766 7/2010
WO WO 2013/079928 6/2013
WO WO 2013/079929 6/2013
WO WO 2013/112273 A2 8/2013
WO WO 2014/018010 A1 1/2014
WO WO 2014/049360 A2 4/2014
WO WO 2014/134741 A1 9/2014

* cited by examiner

APPARATUS AND METHOD FOR MONITORING FLUID FLOW IN A WELLBORE USING ACOUSTIC SIGNALS

CROSS REFERENCE TO RELATED APPLICATIONS

This application is the National Stage of International Application No. PCT/US2013/076282, filed Dec. 18, 2013, which claims the benefit of U.S. Provisional Patent Application No. 61/739,679, filed Dec. 19, 2012, the disclosure of which is hereby incorporated by reference in its entirety. This application is also related to U.S. Ser. Nos. 61/739,414 (PCT/US2013/076273), 61/739,677 (PCT/US2013/076286), 61/739,678 (PCT/US2013/076284), and 61/739,681 (PCT/US2013/076278), each filed on Dec. 19, 2012, the entire contents of each of which are also hereby incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present invention relates to the field of well completions. In addition, the invention relates to the transmission of data along a tubular body within a wellbore. The present invention further relates to the monitoring of fluid flow within a wellbore using acoustic signals.

GENERAL DISCUSSION OF TECHNOLOGY

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing. An annular area is thus formed between the string of casing and the formation penetrated by the wellbore.

A cementing operation is typically conducted in order to displace the drilling fluid and fill an axial portion or all of the annular area between the casing and borehole wall with cement. The combination of cement and casing strengthens the wellbore and facilitates the zonal isolation of certain sections of a hydrocarbon-producing formation (or "pay zones") behind the casing.

A first string of casing is placed from the surface and down to a first drilled depth. This casing is known as a surface casing. In the case of offshore operations, this casing may be referred to as a conductor pipe. Typically, one of the main functions of the initial string(s) of casing is to isolate and protect the shallower, useable water bearing aquifers from contamination by any other wellbore fluids. Accordingly, these casing strings are almost always cemented entirely back to surface.

One or more intermediate strings of casing is also run into the wellbore. These casing strings will have progressively smaller outer diameters into the wellbore. In most current wellbore completion jobs, especially those involving so called unconventional formations where high-pressure hydraulic operations are conducted downhole, these casing strings may be entirely cemented. In some instances, an intermediate casing string may be a liner, that is, a string of casing that is not tied back to the surface.

The process of drilling and then cementing progressively smaller strings of casing is repeated several times until the well has reached total depth. In some instances, the final string of casing is also a liner. The final string of casing, referred to as a production casing, is also typically cemented into place.

Additional tubular bodies may be included in a well completion. These include one or more strings of production tubing placed within the production casing or liner. Each tubing string extends from the surface to a designated depth proximate a production interval, or "pay zone." Each tubing string may be attached to a packer. The packer serves to seal off the annular space between the production tubing string(s) and the surrounding casing.

During hydrocarbon recovery operations, it may be desirable for the operator to understand the nature of fluid flow into a production well. If the well is being stimulated, using an acid or hydraulic fracturing treatment for example, it is also desirable to understand the nature of fluid flow in and out of the wellbore tubulars, flow within the formation, within the completion zone, formation damage due to drilling fluid, flow through the perforations, and flow out of the production well. Similarly, it is desirable for the operator to understand the nature of fluid flow into and out of an injection well. Understanding the flow profile in a well, that is, the rate of fluid flow at different zones in a wellbore, enables the operator to optimize the performance of a production or injection well.

Currently, it is possible to detect and measure the inflow of fluids into a production well (or the outflow of fluids from an injection well) using a flow measurement device. An example of such a device is the flow measurement spinner. The spinner provides a correlation between the number of rotations by a spinning object in the tool with the volume of fluids moving through the tool. The flow measurement spinner is run into the wellbore on a wireline as a production logging tool, or PLT.

The use of a flow measurement spinner has certain drawbacks. One drawback is that PLT spinners do not necessarily provide accurate measurements. This is particularly true in deviated or horizontal wells or in wells that experience multi-phase flow or crossflow in the wellbore. Another drawback is that the device requires a logging crew with a special PLT tool. Having such a crew and tool available can be expensive and very infrequent, especially at offshore fields.

Therefore, a need exists for a system that enables the operator of a wellbore to monitor the inflow or outflow of fluids in real time and without need of a logging crew. Further, a need exists for a system and method for monitoring fluid inflow and outflow that uses permanently mounted communications nodes along the wellbore.

SUMMARY OF THE INVENTION

An electro-acoustic system for downhole telemetry is provided herein. The system employs a series of communications nodes spaced along a wellbore. Each node transmits a signal that represents a packet of information. The packet of information includes both a node identifier and an acoustic wave. The signals are relayed up the wellbore from node-to-node in order to provide a wireless signal to a receiver at the surface indicative of fluid flow measurements.

The system first includes a tubular body within the wellbore. The tubular body may be a string of production tubing. Alternatively, the tubular body may be a string of injection tubing. Alternatively still, the tubular body may be a string of casing. In this instance, the wellbore may have more than one casing string, including a string of surface casing, one or more intermediate casing strings, and a production casing. In any aspect, the wellbore is completed for the purpose of conducting hydrocarbon recovery operations.

The system further has a topside communications node. The topside communications node may be placed along the tubular body proximate a surface. The surface may be an earth surface. Alternatively, in a subsea context, the surface may be an offshore platform at or below a water level. In another embodiment, the topside communications node is connected to the well head.

The system further includes a plurality of subsurface communications nodes. The subsurface communications nodes are attached to an outer or inner wall of the tubular body in spaced-apart relation. In one aspect, the communications nodes are spaced at between about 10 to 100 foot (3.0 to 30.5 meter) intervals or, more preferably, at between about 20 and 40 foot (6.1 to 12.2 meter) intervals. Preferably, each joint of pipe making up the casing string receives one node. However, depending upon the strength of the signal, length of the joint, quality of the signal, etc., a joint may include two or more nodes, or in other embodiments, a node may only be required less frequently, such as on every other joint. The subsea or underground communications nodes such as from a subsea pipe or riser, etc., or buried pipeline, may also be configured to transmit acoustic waves from node-to-node, up to the topside communications node.

Each of the subsurface communications nodes has a sealed housing for protecting internal electronics. In addition, each node relies upon an independent power source. The power source may be, for example, batteries or a fuel cell. The power source resides within the housing.

In addition, each of the subsurface communications nodes has an electro-acoustic transducer. In one aspect, the communications nodes transmit data as mechanical waves at a rate exceeding about 50 bps. In one aspect, the electro-acoustic transducer is associated with a transceiver designed to receive acoustic waves at a first frequency, and then transmit or relay the acoustic waves at a second different frequency. Multiple frequency shift keying (MFSK) may be used as a modulation scheme enabling the transmission of information.

The system also includes a receiver. The receiver is positioned at the surface and is configured to receive signals from the topside communications node. The signals originate with selected subsurface communications nodes, which may be referred to as sensor communications nodes. In one aspect, the receiver is in electrical communication with the topside communications node by means of an electrical wire. In another aspect, the receiver is in electrical communication with the topside communications node through a wireless data transmission such as radio, Wi-Fi or Blue Tooth.

The system also includes one or more sensors. The sensors are placed along the wellbore for the purpose of measuring fluid flow along selected depths or zones. For example, sensors may be placed adjacent a set of perforations at two or more production or injection zones. The sensor delivers signals to respective sensor communications indicative of fluid flow measurements.

Optionally, and in the case of a production well, fluid identification sensors may be used. The fluid identification sensors enable the operator to learn about fluid phases along various depths or zones in the wellbore.

A method of monitoring fluid flow along a wellbore is also provided herein. The method uses a plurality of communications nodes situated along a tubular body to accomplish a wireless transmission of data along the wellbore. The data represents signals that indicate the presence of fluid flow.

The method first includes running joints of pipe into the wellbore. The joints of pipe are connected together at threaded couplings. The joints of pipe are fabricated from a steel material and have a resonant frequency.

The tubular body may be a string of production tubing. Alternatively, the tubular body may be a string of injection tubing. Alternatively still, the tubular body may be a string of casing. In this instance, the wellbore may have more than one casing string, including a string of surface casing, one or more intermediate casing strings, and a production casing. In any aspect, the wellbore is completed for the purpose of conducting hydrocarbon recovery operations.

The method also provides for attaching a series of subsurface communications nodes to the joints of pipe according to a pre-designated spacing. In one aspect, each joint of pipe receives at least one communications node. Preferably, each of the subsurface communications nodes is attached to a joint of pipe by one or more clamps. In this instance, the step of attaching the communications nodes to the joints of pipe comprises clamping the communications nodes to an outer surface of the joints of pipe.

The method also provides for attaching a topside communications node to the wellbore proximate the surface. In one aspect, the topside communications node is attached to an uppermost joint of pipe along the wellbore. Alternatively, and more preferably, the topside communications node is connected to the well head or to a tubular body immediately downstream from the wellhead and above grade. The topside communications node transmits signals from an uppermost subsurface communications node to the surface.

The subsurface communications nodes are configured to transmit acoustic waves, or waveforms, up to the topside communications node. Each subsurface communications node includes a transceiver that receives an acoustic signal from a previous communications node, and then transmits or relays that acoustic signal to a next communications node, in node-to-node arrangement. In one aspect, the communications nodes transmit data as mechanical waves at a rate exceeding about 50 bps.

Selected subsurface communications nodes include (or are in electrical communication with) a flow measurement device, such as a spinner. In addition, selected subsurface communications nodes may include (or are in electrical communication with) a fluid identification sensor, such as but not limited to a microphone or fluid movement measurement device. In addition, selected subsurface communications nodes may include a temperature sensor. Each of these communications nodes are referred to as sensor communications nodes.

The sensor communications nodes generate a signal that corresponds to readings sensed by the respective sensors. The electro-acoustic transceivers in the subsurface communications nodes then transmit acoustic signals up the wellbore representative of the fluid flow, fluid identification, and/or temperature readings, node-to-node.

The method next includes providing a receiver. The receiver is placed at the surface. The receiver has a processor that processes signals received from the topside communications node, such as through the use of firmware and/or software. The receiver preferably receives electrical or optical signals via a so-called "Class I, Division I" conduit, meaning a conduit (as defined by NFPA 497 and API 500) for operation in an electrically classified area. Alternatively, data may be transferred from the topside communications node to the receiver via an electromagnetic (RF) wireless connection. The processor processes the signals to identify which signals correlate to which sensor communications node.

The method also includes analyzing the signals to determine the presence of fluid flow along the wellbore.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 5A, the leading edge, or front, of the shoe is seen. In FIG. 5B, the back of the shoe is seen.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (about 20° C. and 1 atm pressure). Hydrocarbon fluids may include, for example, oil, natural gas, gas condensates, coal bed methane, shale oil, pyrolysis oil, and other hydrocarbons that are in a gaseous or liquid state.

As used herein, the term "subsurface" refers to the region below the earth's surface.

As used herein, the term "sensor" includes any electrical sensing device or gauge. The sensor may be capable of monitoring or detecting pressure, temperature, fluid flow, vibration, fluid type, resistivity, sound, or other formation data.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refer to a portion of a formation containing hydrocarbons. The term "hydrocarbon-bearing formation" may alternatively be used. Zones of interest may also include formations containing brines or useable water which are to be isolated.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member" or "tubular body" refer to any pipe, such as a joint of casing, a portion of a liner, a drill string, a production tubing, an injection tubing or a pup joint. "Tubular body" may also include sand control screens, inflow control devices or valves, sliding sleeve joints, and pre-drilled or slotted liners.

DESCRIPTION OF SELECTED SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

Figure 1A:
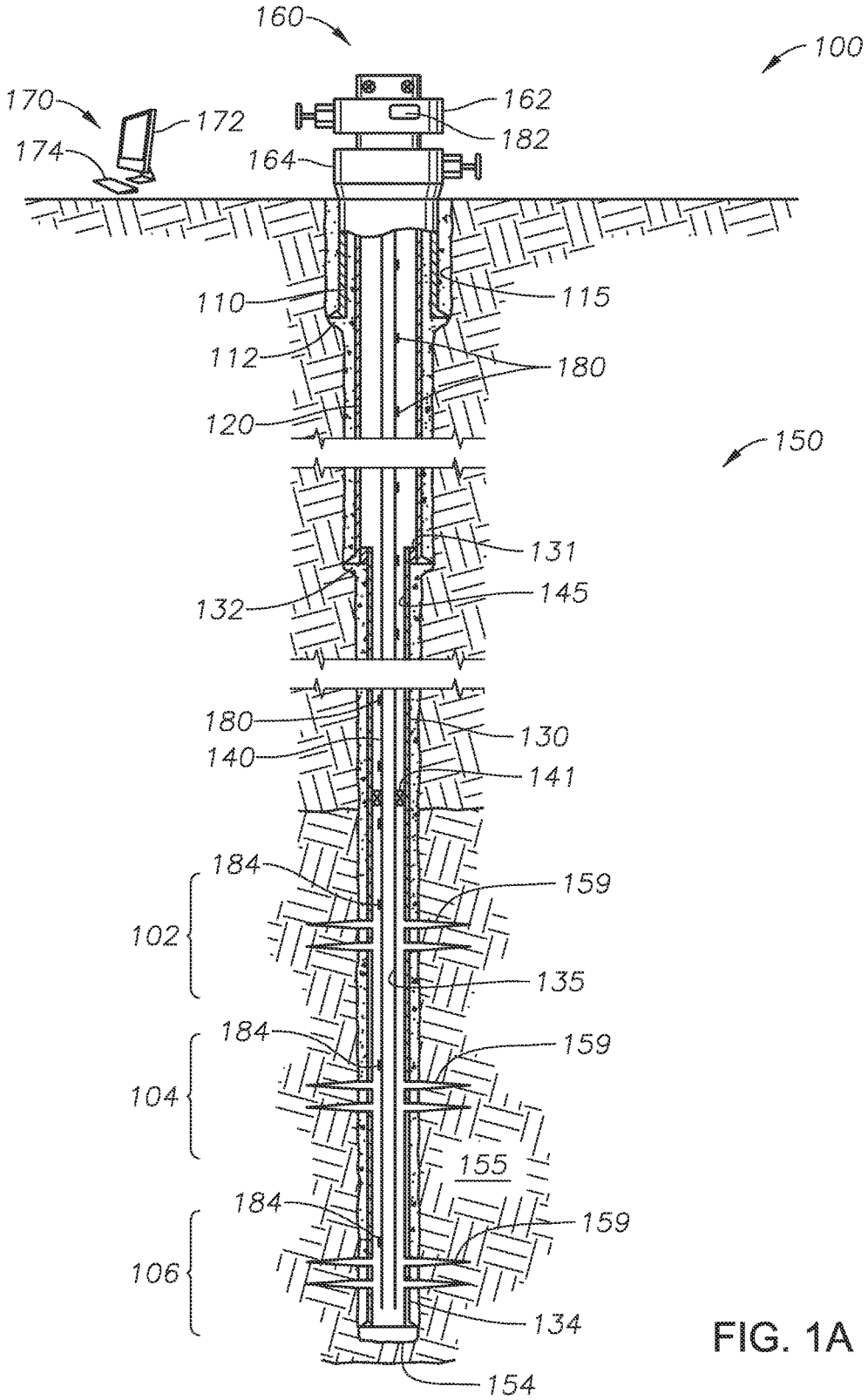
FIG. 1A is a side, cross-sectional view of an illustrative wellbore. The wellbore is completed substantially vertically, and has a string of tubing therein. The tubing may be either a production tubing or an injection tubing. A series of communications nodes is placed along the tubing as part of a telemetry system.

FIG. 1A is a side, cross-sectional view of an illustrative well site 100. The well site 100 includes a wellbore 150 extending from the earth surface 101 and down into an earth subsurface 155. The illustrative wellbore 150 is a production well. However, it may also be considered an injection well.

The wellbore 150 has been completed with a series of pipe strings, referred to as casing. First, a string of surface casing 110 has been cemented into the formation. Cement is shown in an annular bore 115 of the wellbore 150 around the casing 110. The cement is in the form of an annular sheath 112. The surface casing 110 has an upper end in sealed connection with a lower valve 164.

Next, at least one intermediate string of casing 120 is cemented into the wellbore 150. The intermediate string of casing 120 is in sealed fluid communication with an upper valve 162. A cement sheath 112 is again shown in a bore 115 of the wellbore 150. The combination of the casing 110/120 and the cement sheath 112 in the bore 115 strengthens the wellbore 150 and facilitates the isolation of formations behind the casing 110/120.

It is understood that a wellbore 150 may, and typically will, include more than one string of intermediate casing. In some instances, an intermediate string of casing may be a liner. It is also understood that the upper valve 162 and the lower valve 164 are part of a well head 160, which is schematically shown.

Also, a production string 130 is provided. The production string 130 may be a string of production tubing all the way back to the surface, or for further example a production liner that is not tied back to the surface 101. In the arrangement of FIG. 1A, the production string 130 may be hung from the intermediate casing string 120 using a liner hanger 131, and a cement sheath 132 is provided around the liner 130.

The production string 130 extends into the subsurface formation 155. The production string 130 has a lower end 134 that extends to an end 154 of the wellbore 150. For this reason, the wellbore 150 is said to be completed as a cased-hole well.

The production string 130 has been perforated after cementing. Perforations are shown at 159. The perforations 159 create fluid communication between a bore 135 of the liner 130 and the surrounding rock matrix making up the subsurface formation 155. In one aspect, the production string 230 is not a liner but is a casing string that extends back to the surface.

The wellbore 150 also includes a string of production tubing 140. The production tubing 140 extends from the well head 160 down to the subsurface formation 155. In the arrangement of FIG. 1A, the production tubing 140 terminates proximate the end 154 of the wellbore 150. However, it is understood that the production tubing 140 may terminate anywhere along the subsurface formation 155. In one aspect, more than one string of production tubing 140 may be used, with each string terminating along a different zone.

A production packer 141 is provided along the production tubing 140. The illustrative packer 141 is placed proximate the top of the subsurface formation 155. In this way, the packer 141 is able to seal off an annular region 145 between the tubing 140 and the surrounding production liner 130.

The wellbore 150 is completed in several different zones. Three illustrative zones are shown at 102, 104, 106. Perforations 159 are shown at each of these zones.

It is desirable to implement a downhole telemetry system that enables the operator to determine the presence of fluid flow along the different zones 102, 104, 106. This enables the operator to optimize well flow during production or injection operations. To do this, the well site 100 includes a plurality of intermediate communications nodes 180 and one or more sensor communications nodes 184. The communications nodes 180, 182 are placed along the production tubing 140 according to a pre-designated spacing. The communications nodes 180, 184 then send acoustic signals up the wellbore 150 in node-to-node arrangement to a topside communications node 182.

The communications nodes 180, 182, 184 send signals using acoustic telemetry. Acoustic telemetry systems are known in the industry. U.S. Pat. No. 5,924,499 entitled "Acoustic Data Link and Formation Property Sensor for Downhole MWD System" teaches the use of acoustic signals for "short hopping" a component along a drill string. Signals are transmitted from the drill bit or from a near-bit sub and across the mud motors. This may be done by sending separate acoustic signals simultaneously—one that is sent through the drill string, a second that is sent through the drilling mud, and optionally, a third that is sent through the formation. These signals are then processed to extract readable signals.

U.S. Pat. No. 6,912,177, entitled "Transmission of Data in Boreholes," addresses the use of an acoustic transmitter that is as part of a downhole tool. Here, the transmitter is provided adjacent a downhole obstruction such as a shut-in valve along a drill stem so that an electrical signal may be sent across the drill stem. U.S. Pat. No. 6,899,178, entitled "Method and System for Wireless Communications for Downhole Applications," describes the use of a "wireless tool transceiver" that utilizes acoustic signaling. Here, an acoustic transceiver is in a dedicated tubular body that is integral with a gauge and/or sensor. This is described as part of a well completion.

U.S. Pat. No. 4,314,365, entitled "Acoustic Transmitter and Method to Produce Essentially Longitudinal, Acoustic Waves, teaches a "portable, electrohydraulic, acoustic transmitter" that attaches to an outer surface of a drill string. The transmitter is used to send acoustic signals down a drill string to a downhole receiver. When actuated, the downhole receiver activates a subsurface "instrument package" which performs a desired "downhole function."

None of these patents disclose an acoustic telemetry system that enables an operator to receive signals at the surface that are indicative of fluid flow within a wellbore (including but not limited to flow within a wellbore tubular, or in the annulus between the tubular and the wellbore wall, or in the formation substantially adjacent or proximate to the wellbore wall, or within completion equipment, or within channels or voids in the wellbore annulus, etc.). In contrast, the well site 100 of FIG. 1A presents a telemetry system that utilizes a series of novel communications nodes 180, 182, 184 placed along the wellbore 150. These nodes 180, 182, 184 allow for the high speed transmission of wireless signals based on the in situ generation of acoustic waves. The waves represent wave forms that may be processed and analyzed at the surface.

The nodes first include a topside communications node 182. The topside communications node 182 is placed closest to the surface 101. The topside communications node 182 is configured to receive acoustic signals and convert them to electrical or optical signals. The topside communications node 182 may be above grade or below grade. In the arrangement of FIG. 1A, the topside communications node 182 is connected to the well head 160.

In addition, the nodes include a plurality of subsurface communications nodes 180. The subsurface communications nodes 180 are configured to transmit acoustic signals along the length of the wellbore 150 up to the topside communications node 182.

In FIG. 1A, the intermediate communications nodes 180 are shown schematically. However, FIG. 3 offers an enlarged perspective view of an illustrative pipe joint 300, along with a communications node 350. The illustrative communications node 350 is shown exploded away from the pipe joint 300.

Figure 3:
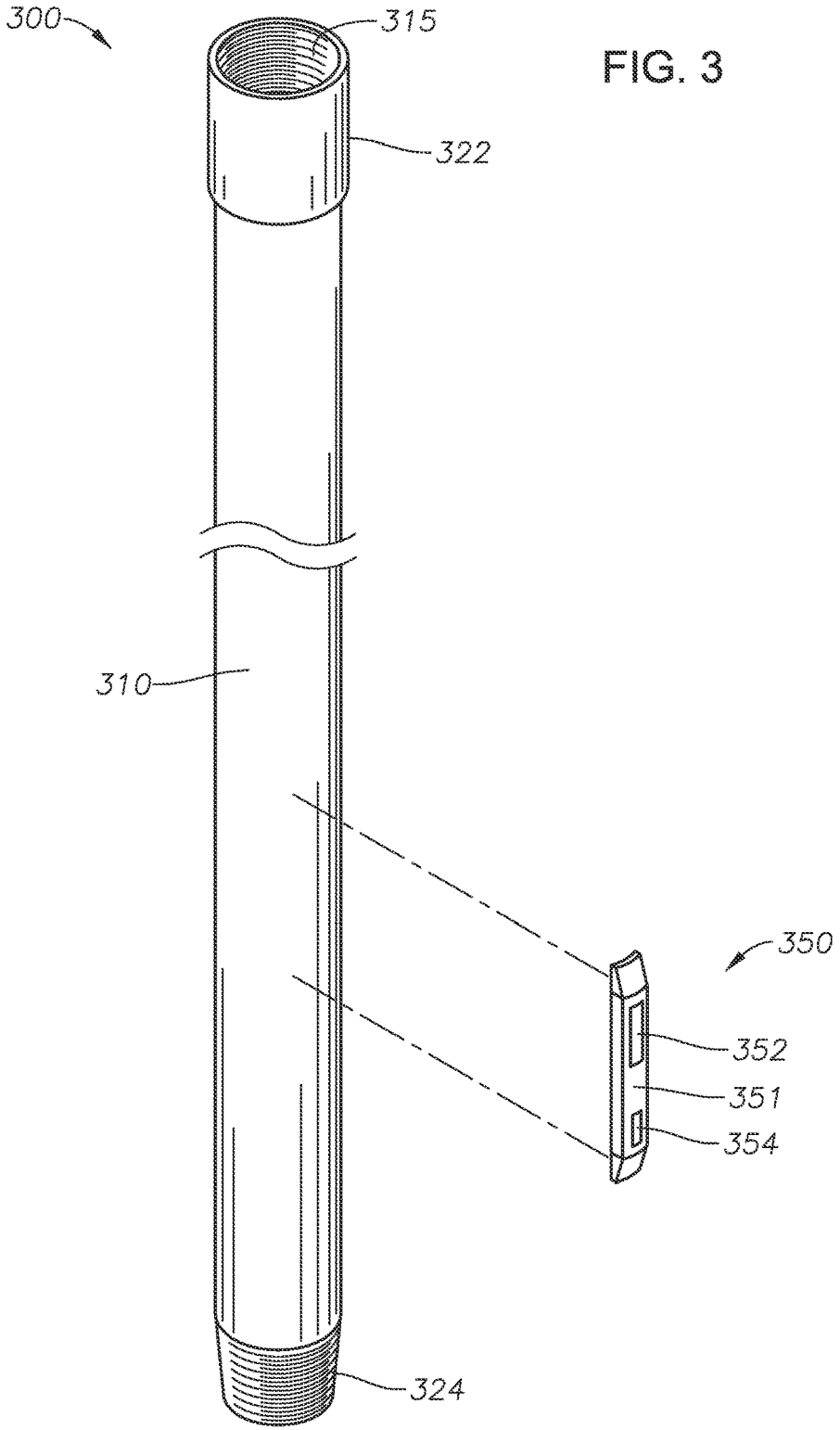
FIG. 3 is a perspective view of an illustrative wellbore tubular joint. A communications node of the present invention, in one embodiment, is shown exploded away from the casing joint.

In FIG. 3, the illustrated pipe joint 300 is intended to represent a joint of casing. However, the pipe joint 300 may be any other tubular body such as a joint of tubing, drill pipe, or a pipeline. The pipe joint 300 has an elongated wall 310 defining an internal bore 315. The bore 315 transmits drilling fluids such as an oil based mud, or OBM, during a drilling operation. The bore 315 also receives a string of tubing (such as production tubing or injection tubing, not shown), once a wellbore is completed.

The illustrated pipe joint 300 has a box end 322 having internal threads, such a through use is a threaded connector collar or with an integrated threaded box joint. In addition, the pipe joint 300 has a pin end 324 having external threads. The threads may be of any design. Tubing joints and casing joints have a slightly different general end appearance than the illustrated drill pipe joint, but these are also tubular bodies that may be equipped similar to the illustrated drill pipe joint 300.

As noted, an illustrative communications node 350 is shown for illustration purposes, exploded away from the pipe joint 300. The exemplary communications node 350 is designed to attach to a wall 410 of the pipe joint 300 at a selected location. In one aspect, each pipe joint 300 will have a communications node 350 between the box end 322 and the pin end 324. In one arrangement, the communications node 350 is placed immediately adjacent the box end 322 or, alternatively, immediately adjacent the pin end 324 of every joint of pipe. In another arrangement, the communications node 350 is placed at a selected location along every second or every third pipe joint 300 in a drill string. In still another arrangement, at least some pipe joints 300 receive two communications nodes 350.

The communications node 350 shown in FIG. 3 is designed to be pre-welded onto the wall 310 of the pipe joint 300. Alternatively, the communications node 350 may be glued using an adhesive such as epoxy. However, it is preferred that the communications node 350 be configured to be selectively attachable to/detachable from a pipe joint 300 by mechanical means at a well site. This may be done, for example, through the use of clamps. Such a clamping system is shown at 600 in FIG. 6, described more fully below. In any instance, the communications node 350 is an independent wireless communications device that is designed to be attached to an external surface of a well pipe.

There are benefits to the use of an externally-placed communications node that uses acoustic waves. For example, such a node will not interfere with the flow of fluids within the internal bore 315 of the pipe joint 300 or decrease the effective inner diameter which would interfere with passing subsequent assemblies or tubulars through. Further, installation and mechanical attachment can be readily assessed and adjusted.

In FIG. 3, the communications node 350 includes an elongated body 351. The body 351 supports one or more batteries, shown schematically at 352. The body 351 also supports an electro-acoustic transducer, shown schematically at 354. The electro-acoustic transducer 354 is associated with a transceiver that transmits acoustic signals to a next communications node.

The communications node 350 is intended to represent the communications nodes 180 of FIG. 1A, in one embodiment. The electro-acoustic transducer 354 in each node 180 allows signals to be sent from node-to-node, up the wellbore 150, as acoustic waves. The acoustic waves may be at a frequency of, for example, between about 50 kHz and 500 kHz. A last subsurface communications node 180 transmits the signals to the topside node 182. Beneficially, the subsurface communications nodes 180 do not require a wire or cable to transmit data to the surface. Preferably, communication is routed around nodes which are not functioning properly.

The well site 100 of FIG. 1A also shows a receiver 170. The receiver 170 comprises a processor 172 that receives signals sent from the topside communications node 182. The signals may be received through a wire (not shown) such as a co-axial cable, a fiber optic cable, a USB cable, or an electrical conduit or optical communications wire. Alternatively, the receiver 170 may receive the signals from the topside communications node 182 wirelessly through a modem, a transceiver or other wireless communications link such as Bluetooth or Wi-Fi. The receiver 170 preferably receives electrical signals via a so-called Class I, Division I conduit, that is, a housing for wiring that is considered acceptably safe in an explosive environment. In some applications, radio, infrared or microwave signals may be utilized.

The processor 172 may include discrete logic, any of various integrated circuit logic types, or a microprocessor. In any event, the processor 172 may be incorporated into a computer having a screen. The computer may have a separate keyboard 174, as is typical for a desk-top computer, or an integral keyboard as is typical for a laptop or a personal digital assistant. In one aspect, the processor 172 is part of a multi-purpose "smart phone" having specific "apps" and wireless connectivity.

The downhole telemetry system also includes sensor communications nodes 184. The sensor communications nodes 184 are in electrical communication with a sensor. Preferably, selected subsurface communications nodes house a sensor, and serve as sensor communications nodes 184. The sensors will include fluid flow measurement devices. The sensor may also include fluid identification sensor and/or temperature sensors.

Figure 1B:
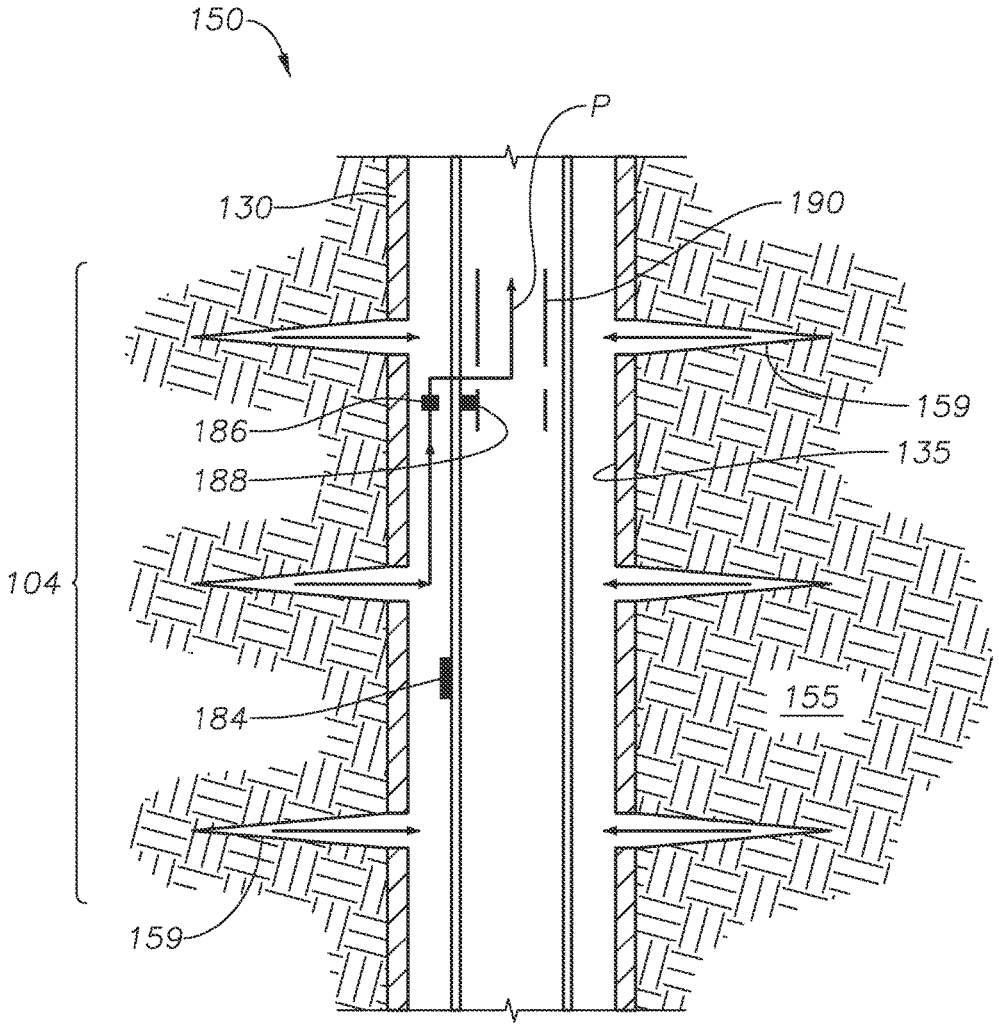
FIG. 1B is an enlarged cross-sectional view of a portion of the illustrative wellbore of FIG. 1A. Here, a selected production zone within a subsurface formation is seen more clearly.

FIG. 1B provides an enlarged cross-sectional view of a portion of the illustrative wellbore 150 of FIG. 1A. Here, production zone 104 from the subsurface formation 155 is seen in an expanded view. A sensor communications node 184 shown along the production tubing 140. Production fluids, indicated by arrow "P," indicates the flow of fluids into the production tubing 140 through an inflow control device 190.

Two sensors are shown schematically along the inflow control device 190. A first sensor 186 is a fluid measurement device. This device 186 detects the flow of fluid through the inflow control device 190. Preferably, the fluid measurement device 186 also measures volume of fluid flow there through. Downhole flow measurement devices are known in the industry and are adaptable for interfacing with a sensor communications node 184. A preferred example is the axial turbine flow meter, referred to as a "spinner" on production logging tools. Here, the speed of the rotating spinner is proportional to the fluid velocity.

As another option, an ultrasonic flow meter may be clamped onto the outside of production tubing. Alternatively, the meter may be fabricated with threaded ends so that production tubing joints can be screwed into it.

A laser optical flow meter may be used to measure fluid flow. Here, two laser beams are focused a short distance apart in the production tubing flow path. Small solid particles being carried by the fluid that cross the laser beams will scatter the light. A photodetector collects the scattered light. The fluid velocity can be determined based on the time between when the particles scatter the first and second light beams.

Another device is the acoustic Doppler velocimetry tool. Here, the speed of a particle carried by the fluid is measured based on the acoustic Doppler shift effect. Still another device is the Coriolis flow meter. This device relies upon a vibrating tube which would be mounted inside the production tubing.

Yet another fluid measurement device is the thermal mass flow meter. This device uses a heating element that is attached to either the outside or the inside of the production tubing. Temperature sensors are attached on either side of the heating element. The temperature differential between the temperature sensors depends upon the flow rate of the fluid. Velocity can be determined if the specific heat and density of the flowing fluid are known along with the measured $\Delta T$.

Other flow measurement devices which use the principles of a Venturi nozzle may be used. Pressure sensors are used to record the differential pressure on either side of a nozzle or other constriction in the tubing. An example is a V-Cone flow meter or Venturi meter. Alternatively, a pitot tube mounted or extended into the production tubing may be used.

As another option, a piezoelectric transducer or similar device capable of measuring sound may be clamped onto the outside of production tubing. The properties of the sound waves emitted by flowing fluid can be correlated to the flow rate.

The second sensor 188 is a fluid identification sensor. This sensor 188 uses optometrics or related technology known in the industry to identify a fluid type at the level of the inflow control device 190.

Each sensor 186, 188 is associated with the sensor communications node 184. In this respect, each sensor 186, 188 sends an electrical signal that is indicative of fluid flow in the wellbore 150. The electrical signal is delivered to the sensor communications node 184. An electro-acoustic transducer within the sensor communications node 184 then converts that signal into an acoustic signal. The acoustic signal is then transmitted to a next communications node 180 along the production tubing 140.

The acoustic signal represents a packet of data. The packet of data will first include an identifier for the sensor communications node 184 that originally transmitted the signal. The packet of data will also include a waveform indicative of the sensor readings from the sensors 186, 188. Preferably, the sensor communications node 184 will also house a temperature sensor. In this way, the waveform will also be indicative of temperature readings at the depth of the sensor communications node 184.

It is noted that the operator will maintain a wellbore diagram that generally informs as to where the various sensor communications nodes are located. In addition, the processor 172 will be programmed to associate the identification of the sensor communications node 184 transmitting a signal with the depth of the sensor reading(s). This is referred to in the telemetry industry as an address.

FIGS. 1A and 1B demonstrate the use of a wireless data telemetry system wherein communications nodes are placed along a string of tubing. The illustrative wellbore 150 is completed vertically. However, the wireless downhole telemetry system may also be employed in wells that are deviated or that are horizontally completed. Further, the telemetry system may employ nodes along the casing string of a wellbore.

Figure 2:
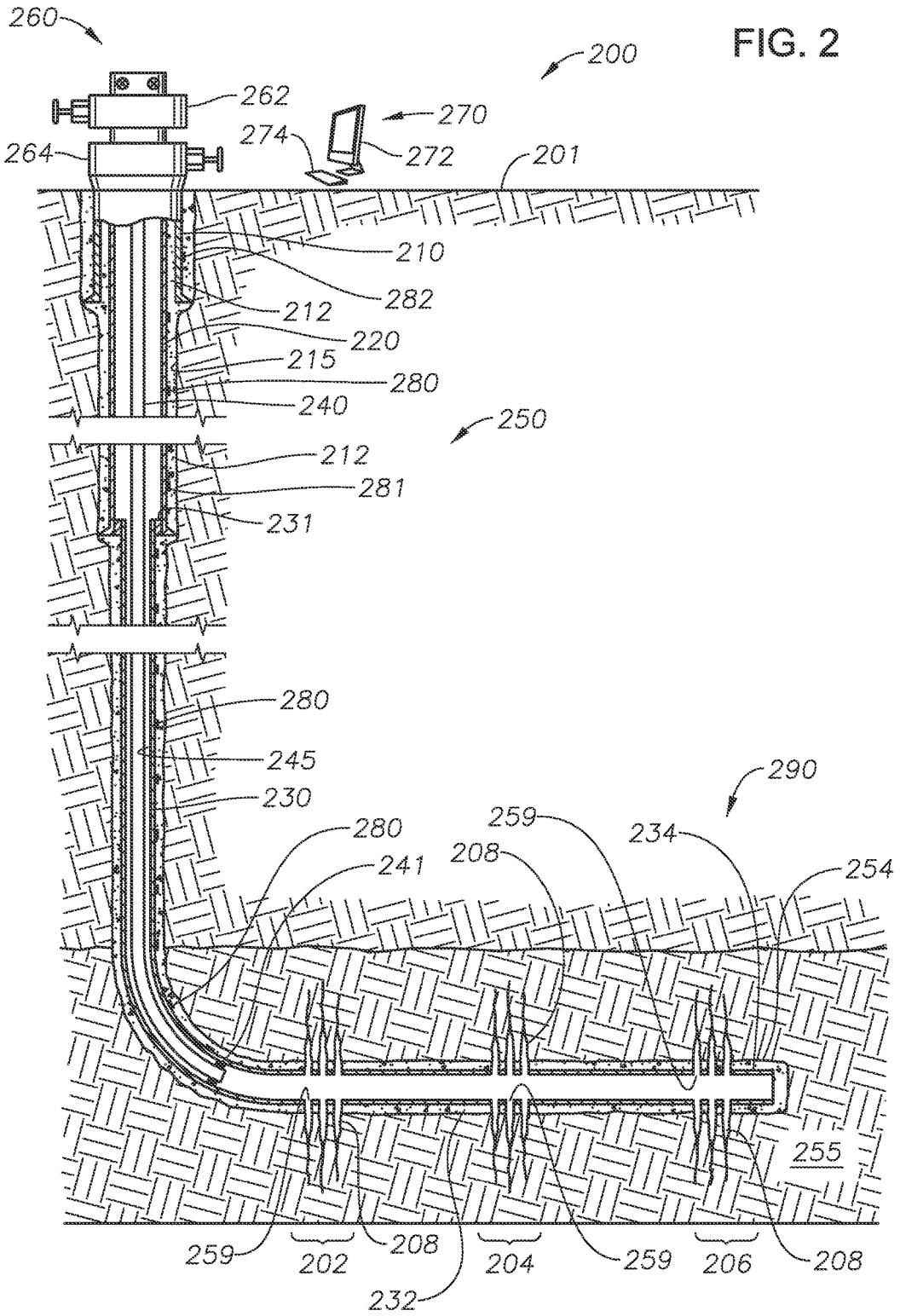
FIG. 2 is a cross-sectional view of another wellbore having been completed. The illustrative wellbore has been completed as a horizontal completion. A series of communications nodes is placed along the casing string as part of a telemetry system.

FIG. 2 is a cross-sectional view of an illustrative well site 200. The well site 200 includes a wellbore 250 that penetrates into a subsurface formation 255. The wellbore 250 has been completed as a cased-hole completion for producing hydrocarbon fluids. The well site 200 also includes a well head 260. The well head 260 is positioned at an earth surface 201 to control and direct the flow of formation fluids from the subsurface formation 255 to the surface 201.

The wellbore 250 has been completed horizontally using directional drilling. There are several advantages to directional drilling. These primarily include the ability to complete a wellbore along a substantially horizontal axis of a subsurface formation, thereby exposing a greater formation face. These also include the ability to penetrate into subsurface formations that are not located directly below the well head 260. This is particularly beneficial where an oil reservoir is located under an urban area or under a large body of water. Another benefit of directional drilling is the ability to group multiple well heads on a single platform, such as for offshore drilling. Finally, directional drilling enables multiple laterals and/or sidetracks to be drilled from a single wellbore in order to maximize reservoir exposure and recovery of hydrocarbons.

Referring first to the well head 260, the well head 260 may be any arrangement of pipes or valves that receive reservoir fluids at the top of the well. In the arrangement of FIG. 2, the well head 260 represents a so-called Christmas tree. A Christmas tree is typically used when the subsurface formation 255 has enough in situ pressure to drive production fluids from the formation 255, up the wellbore 250, and to the surface 201. The illustrative well head 260 includes a top valve 262 and a bottom valve 264.

It is understood that rather than using a Christmas tree, the well head 260 may alternatively include a motor (or prime mover) at the surface 201 that drives a pump. The pump, in turn, reciprocates a set of sucker rods and a connected positive displacement pump (not shown) downhole. The pump may be, for example, a rocking beam unit or a hydraulic piston pumping unit. Alternatively still, the well head 260 may be configured to support a string of production tubing having a downhole electric submersible pump, a gas lift valve, or other means of artificial lift (not shown). The present inventions are not limited by the configuration of production equipment at the surface unless expressly noted in the claims.

Referring next to the wellbore 250, the wellbore 250 has been completed with a series of pipe strings referred to as casing. The casing is generally similar to that provided in the wellbore of FIG. 1A. In this respect, a surface casing 210, one or more strings of intermediate casing 220, and a production casing 230 are provided. The casing strings 210, 220, 230 are fixed in the wellbore by a cement sheath 212/232 residing within an annular region 215.

The surface casing 210 has an upper end in sealed connection with the lower valve 264. Similarly, the intermediate string of casing 220 is in sealed fluid communication with the upper valve 262. The production string 230 has a lower end 234 that extends to an end 254 of the wellbore 250. For this reason, the wellbore 250 is said to be completed as a cased-hole well. Those of ordinary skill in the art will understand that for production purposes, the liner 230 may be perforated after cementing to create fluid communication between a bore 235 of the liner 230 and the surrounding rock matrix making up the subsurface formation 255. In one aspect, the production string 230 is not a liner but is a casing string that extends back to the surface.

As an alternative, end 254 of the wellbore 250 may include joints of sand screen (not shown). The use of sand screens with gravel packs allows for greater fluid communication between the bore 235 of the liner 230 and the surrounding rock matrix while still providing support for the wellbore 250. In this instance, the wellbore 250 would include a slotted base pipe as part of the sand screen joints. Of course, the sand screen joints would not be cemented into place and would not include subsurface communications nodes.

The wellbore 250 optionally also includes a string of production tubing 240. The production tubing 240 extends from the well head 260 down to the subsurface formation 255. In the arrangement of FIG. 2, the production tubing 240 terminates proximate an upper end of the subsurface formation 255. A production packer 241 is provided at a lower end of the production tubing 240 to seal off an annular region 245 between the tubing 240 and the surrounding production liner 230. However, the production tubing 240 may extend closer to the end 234 of the liner 230.

In some completions a production tubing 240 is not employed. This may occur, for example, when a monobore is in place.

It is also noted that the bottom end 234 of the production string 230 is completed substantially horizontally within the subsurface formation 255. This is a common orientation for wells that are completed in so-called "tight" or "unconventional" formations. Horizontal completions not only dramatically increase exposure of the wellbore to the producing rock face, but also enables the operator to create fractures that are substantially transverse to the direction of the wellbore. However, the present inventions have equal utility in vertically completed wells or in multi-lateral deviated wells.

As with the well site 100 of FIG. 1, the well site 200 of FIG. 2 includes a telemetry system that utilizes a series of novel communications nodes. This again is for the purpose of monitoring fluid flow within the wellbore 250. Here, communications nodes 280, 282, 284 are placed along the outer diameter of the casing strings 210, 220, 230. These nodes allow for the high speed transmission of wireless signals based on the in situ generation of acoustic waves.

The nodes first include a topside communications node 282. The topside communications node 282 is placed closest to the surface 201. The topside node 282 is configured to receive acoustic signals. In the arrangement of FIG. 2, the topside communications node 282 is attached to a top casing joint within the wellbore 250. However, the topside communications node 282 is more preferably attached to the well head 260. Either arrangement is considered to be "along the wellbore."

In addition, the nodes include a plurality of subsurface communications nodes 280. Each of the subsurface communications nodes 280 is configured to receive and then relay acoustic signals along essentially the length of the wellbore 250. Preferably, the subsurface communications nodes 280 utilize electro-acoustic transceivers to receive and relay mechanical waves.

The subsurface communications nodes 280 transmit signals as acoustic waves. The acoustic waves are preferably at a frequency of between about 50 kHz and 500 kHz, and more preferably between about 100 kHz and 125 kHz. The signals are delivered up to the topside communications node 282, in node-to-node arrangement.

The signals originate with sensors located along the wellbore 250. The sensor may be, for example, the fluid measurement device 186 and the fluid identification sensor 188 shown in FIG. 1B. These sensor are associated with a sensor communications node 284. Alternatively or in addition, the sensor may be a temperature sensor residing within or adjacent to a sensor communications node 284. As describe above, an electro-acoustic transducer within the sensor communications node 284 converts the signals from the sensors into an acoustic signal. The acoustic signal is then transmitted to a next communications node 180 along the production tubing 240 by means of a transceiver within the sensor communications node 184.

The acoustic signal represents a packet of data. The packet of data will first include an identifier for the sensor communications node 284 that originally transmitted the signal. The packet of data will also include a waveform indicative of the sensor readings from the sensors.

The well site 200 of FIG. 2 shows a receiver 270. The receiver 270 comprises a processor 272 that receives signals sent from the topside communications node 284. The processor 272 may include discrete logic, any of various integrated circuit logic types, or a microprocessor. The receiver 270 may include a screen and a keyboard 274 (either as a keypad or as part of a touch screen). The receiver 270 may also be an embedded controller with neither a screen nor a keyboard which communicates with a remote computer via cellular modem or telephone lines.

The signals may be received by the processor 272 through a wire (not shown) such as a co-axial cable, a fiber optic cable, a USB cable, or other electrical or optical communications wire. Alternatively, the receiver 270 may receive the final signals from the topside node 282 wirelessly through a modem or transceiver. The receiver 270 preferably receives electrical signals via a so-called Class I, Div. 1 conduit, that is, a wiring system or circuitry that is considered acceptably safe in an explosive environment.

FIGS. 1A and 2 present illustrative wellbores 150, 250 that may receive a downhole telemetry system using acoustic transducers. In each of FIGS. 1A and 2, the top of the drawing page is intended to be toward the surface and the bottom of the drawing page toward the well bottom. While wells commonly are completed in substantially vertical orientation, it is understood that wells may also be inclined and even horizontally completed. When the descriptive terms "up" and "down" or "upper" and "lower" or similar terms are used in reference to a drawing, they are intended to indicate location on the drawing page, and not necessarily orientation in the ground, as the present inventions have utility no matter how the wellbore is orientated.

In each of FIGS. 1A and 2, the communications nodes 180, 280 are specially designed to withstand the same corrosion and environmental conditions (high temperature, high pressure) of a wellbore 150 or 250 As the casing, drill string, or production tubing. To do so, it is preferred that the communications nodes 180, 280 include steel housings for holding the electronics. In one aspect, the steel material is a corrosion resistant alloy.

Figure 4A:
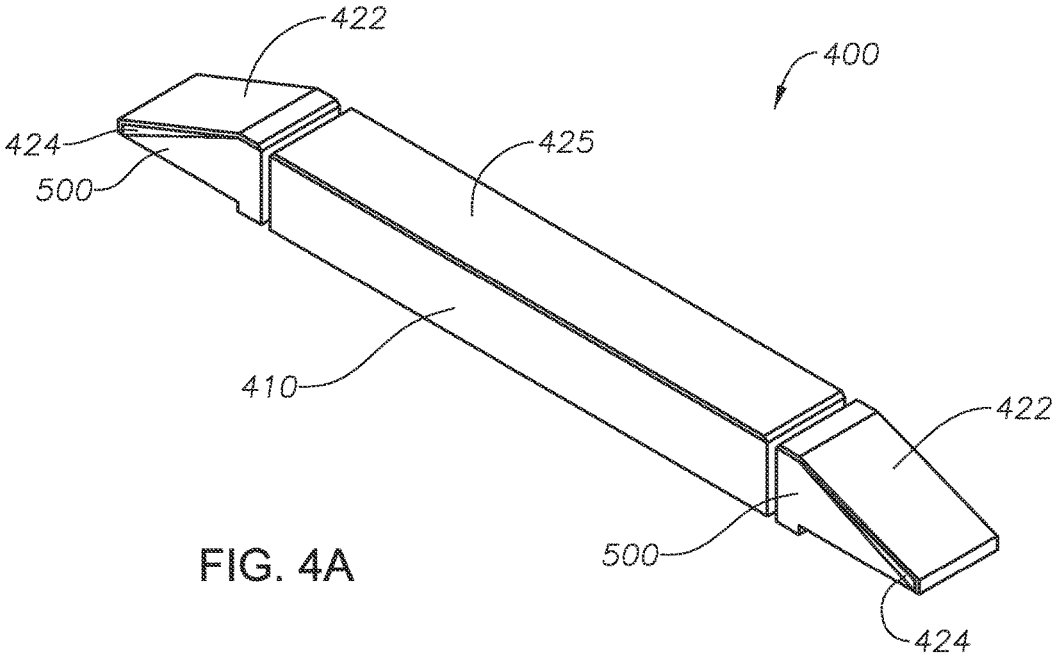
FIG. 4A is a perspective view of a communications node as may be used in the wireless data transmission system of the present invention, in an alternate embodiment.
Figure 4B:
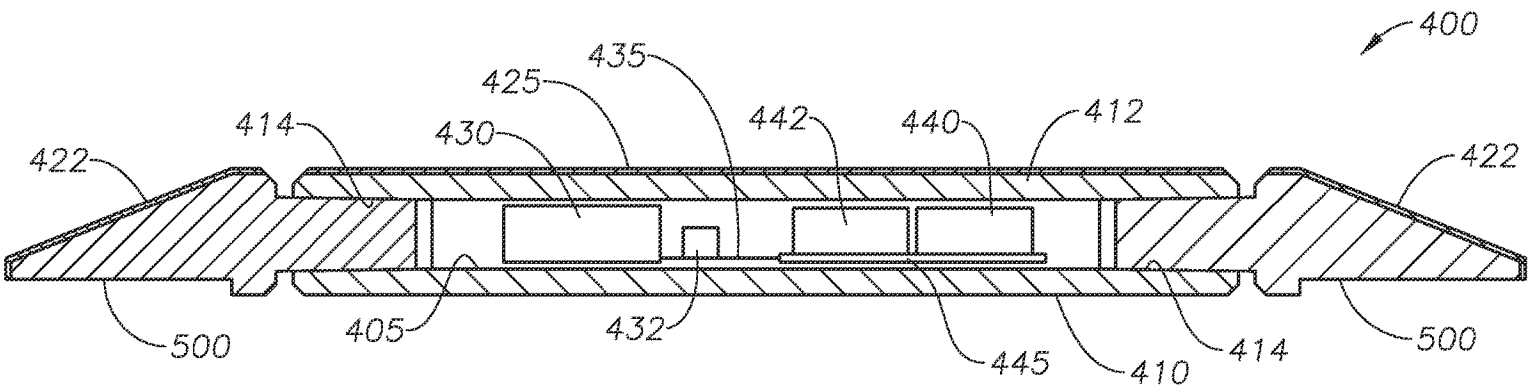
FIG. 4B is a cross-sectional view of the communications node of FIG. 4A. The view is taken along the longitudinal axis of the node. Here, a sensor is provided within the communications node.

FIG. 4A is a perspective view of a communications node 400 as may be used in the wireless data transmission systems of FIG. 1A or FIG. 2 (or other wellbore), in one embodiment. The communications node 400 is designed to provide data communication using a transceiver within a novel downhole housing assembly. FIG. 4B is a cross-sectional view of the communications node 400 of FIG. 4A. The view is taken along the longitudinal axis of the node 400. The communications node 400 will be discussed with reference to FIGS. 4A and 4B, together.

The communications node 400 first includes a fluid-sealed housing 410. The housing 410 is designed to be attached to an outer wall of a joint of wellbore pipe, such as the pipe joint 300 of FIG. 3. Where the wellbore pipe is a carbon steel pipe joint such as drill pipe, casing or liner, the housing 410 is preferably fabricated from carbon steel. This metallurgical match avoids galvanic corrosion at the coupling.

The housing 410 includes an outer wall 412. The wall 412 is dimensioned to protect internal electronics for the communications node 400 from wellbore fluids and pressure. In one aspect, the wall 412 is about 0.2 inches (0.51 cm) in thickness. The housing 410 optionally also has a protective outer layer 425. The protective outer layer 425 resides external to the wall 412 and provides an additional thin layer of protection for the electronics.

A bore 405 is formed within the wall 412. The bore 405 houses the electronics, shown in FIG. 4B as a battery 430, a power supply wire 435, a transceiver 440, and a circuit board 445. The circuit board 445 will preferably include a micro-processor or control logic associated with the transceiver 440 for digitizing acoustic signals. An electro-acoustic transducer 442 is provided to convert acoustical energy to electrical energy (or vice-versa) and is coupled with outer wall 412 on the side attached to the tubular body. The transducer 442 is in electrical communication with a sensor 432.

Figure 4C:
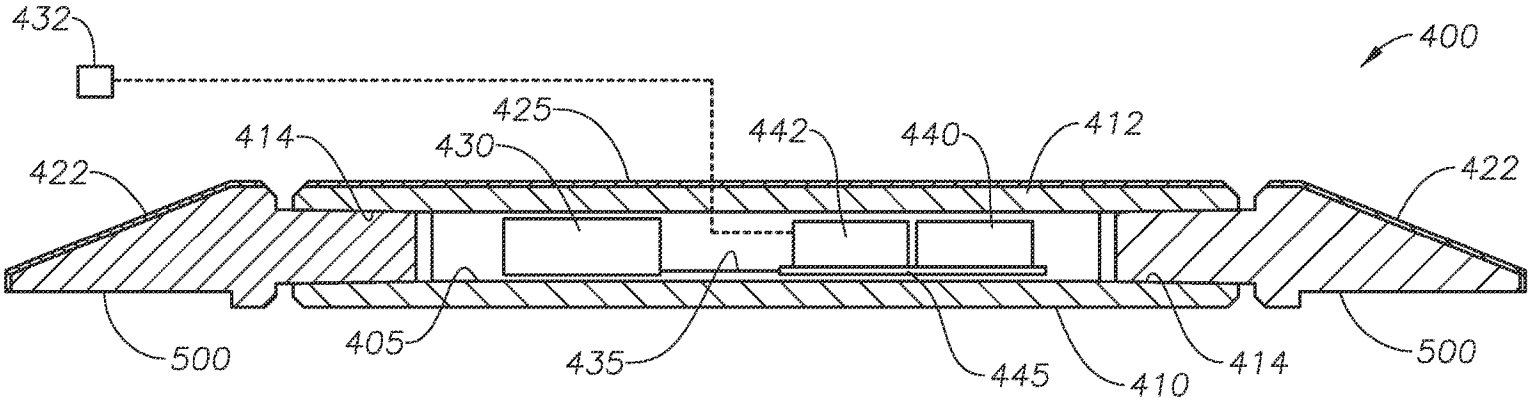
FIG. 4C is another cross-sectional view of the communications node of FIG. 4A. The view is again taken along the longitudinal axis of the node. Here, a sensor resides along the wellbore external to the communications node.

It is noted that in FIG. 4B, the sensor 432 resides within the housing 410 of the communications node 400. However, as noted, the sensor 432 may reside external to the communications node 400, such as above or below the node 400 along the wellbore. In FIG. 4C, a dashed line is provided showing an extended connection between the sensor 432 and the electro-acoustic transducer 442.

The transceiver 440 will receive an acoustic telemetry signal. In one preferred embodiment, the acoustic telemetry data transfer is accomplished using multiple frequency shift keying (MFSK). Any extraneous noise in the signal is moderated by using well-known conventional analog and/or digital signal processing methods. This noise removal and signal enhancement may involve conveying the acoustic signal through a signal conditioning circuit using, for example, a bandpass filter.

The transceiver will also produce acoustic telemetry signals. In one preferred embodiment, an electrical signal is delivered to an electromechanical transducer, such as through a driver circuit. In a preferred embodiment, the transducer is the same electro-acoustic transducer that originally received the MFSK data. The signal generated by the electro-acoustic transducer then passes through the housing 410 to the tubular body (such as production tubing 240), and propagates along the tubular body to other communication nodes. The re-transmitted signal represents the same sensor data originally transmitted by sensor communications node 284. In one aspect, the acoustic signal is generated and received by a magnetostrictive transducer comprising a coil wrapped around a core as the transceiver. In another aspect, the acoustic signal is generated and received by a piezoelectric ceramic transducer. In either case, the electrically encoded data are transformed into a sonic wave that is carried through the wall of the tubular body in the wellbore.

Each transceiver 440 is associated with a specific joint of pipe. That joint of pipe, in turn, has a known location or depth along the wellbore. The acoustic wave as originally transmitted from the transceiver 440 will represent a packet of information. The packet will include an identification code that tells a receiver (such as receiver 270 in FIG. 2) where the signal originated, that is, which communications node 400 it came from. In addition, the packet will include an amplitude value originally recorded by the communications node 400 for its associated joint of pipe.

When the signal reaches the receiver at the surface, the signal is processed. This involves identifying which communications node the signal originated from, and then determining the location of that communications node along the wellbore. This may further involve comparing the original amplitude value with a baseline value. The baseline value represents an anticipated temperature indicative of the presence of a wellbore fluid.

The communications node 400 optionally also includes one or more sensors 432. The sensors 432 may be, for example, pressure sensors, temperature sensors, acoustic/sound/seismic sensors, fluid identification sensor, or fluid flow measurement sensors. The sensor 432 sends signals to the transceiver 440 through a short electrical wire 435 or through the printed circuit board 435. Signals from the sensor 432 are converted into acoustic signals that are sent by the transceiver 440 as part of the packet of information.

In one aspect, the sensors measure or are used to infer fluid composition along a wellbore. These sensors may be, for example, (i) temperature sensors, (ii) fluid identification sensors, (iii) amp meters or volt meters that measure an electrical current that is passed along a body of a subsurface communications node, (iv) an electrical device that measures a capacitance of fluid, (v) a microphone, (vi) a device for measuring fluid density, and (vii) a device for measuring rheology of fluid density in proximity to a corresponding subsurface communications node. In this instance, the subsurface communications nodes are configured to receive and relay acoustic signals indicative of readings taken by the fluid composition sensors up to the surface.

The communications node 400 also optionally includes a shoe 500. More specifically, the node 400 includes a pair of shoes 500 disposed at opposing ends of the wall 412. Each of the shoes 500 provides a beveled face that helps prevent the node 400 from hanging up on an external tubular body or the surrounding earth formation, as the case may be, during run-in or pull-out. The shoes 500 may have a protective outer layer 422 and an optional cushioning material 424 under the outer layer 422.

Figure 5A:
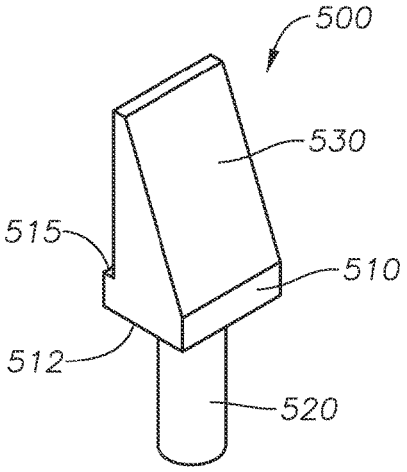
FIGS. 5A and 5B are perspective views of a shoe as may be used on opposing ends of the communications node of FIG. 4A, in one embodiment.
Figure 5B:
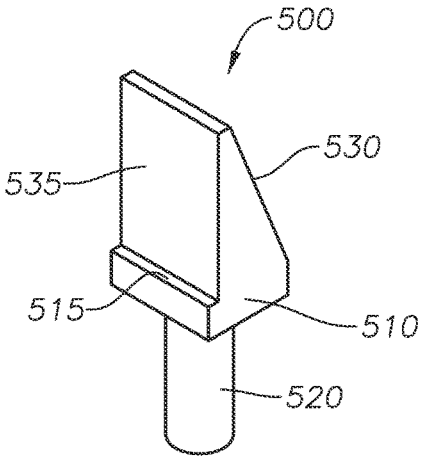

FIGS. 5A and 5B are perspective views of an illustrative shoe 500 as may be used on an end of the communications node 400 of FIG. 4A, in one embodiment. In FIG. 5A, the leading edge or front of the shoe 500 is seen, while in FIG. 4B the back of the shoe 500 is seen.

The shoe 500 first includes a body 510. The body 510 includes a flat under-surface 512 that butts up against opposing ends of the wall 412 of the communications node 400.

Extending from the under-surface 512 is a stem 520. The illustrative stem 520 is circular in profile. The stem 520 is dimensioned to be received within opposing recesses 414 of the wall 412 of the node 400.

Extending in an opposing direction from the body 510 is a beveled surface 530. As noted, the beveled surface 530 is designed to prevent the communications node 400 from hanging up on an object during run-in into a wellbore.

Behind the beveled surface 530 is a flat (or slightly arcuate) surface 535. The surface 535 is configured to extend along the drill string 160 (or other tubular body) when the communications node 400 is attached along the tubular body. In one aspect, the shoe 500 includes an optional shoulder 515. The shoulder 515 creates a clearance between the flat surface 535 and the tubular body opposite the stem 520.

In one arrangement, the communications nodes 400 with the shoes 500 are welded onto an outer surface of the tubular body, such as wall 310 of the pipe joint 300. More specifically, the body 410 of the respective communications nodes 400 are welded onto the wall of a joint of casing. In some cases, it may not be feasible or desirable to pre-weld the communications nodes 400 onto pipe joints before delivery to a well site. Further still, welding may degrade the tubular integrity or damage electronics in the housing 410. Therefore, it is desirable to utilize a clamping system that allows a drilling or service company to mechanically connect/disconnect the communications nodes 400 along a tubular body as the tubular body is being run into a wellbore.

Figure 6:
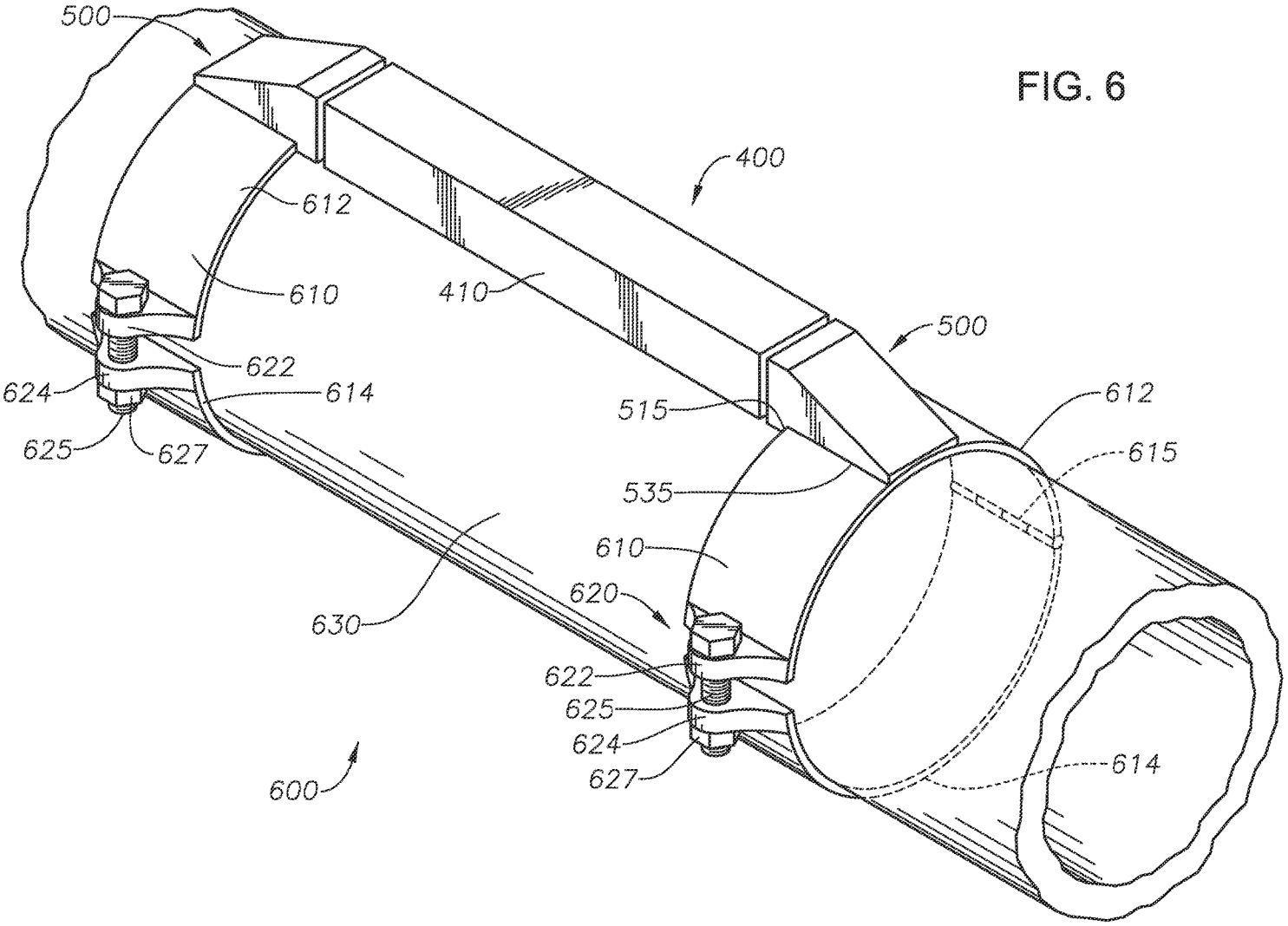
FIG. 6 is a perspective view of a communications node system as may be used in the methods of the present invention, in one embodiment. The communications node system utilizes a pair of clamps for connecting a subsurface communications node onto a tubular body.

FIG. 6 is a perspective view of a communications node system 600 as may be used for methods of the present invention, in one embodiment. The communications node system 600 utilizes a pair of clamps 610 for mechanically connecting a communications node 400 onto a tubular body 630 such as a joint of casing or liner.

The system 600 first includes at least one clamp 610. In the arrangement of FIG. 6, a pair of clamps 610 is used. Each clamp 610 abuts the shoulder 515 of a respective shoe 500. Further, each clamp 610 receives the base 535 of a shoe 500. In this arrangement, the base 535 of each shoe 500 is welded onto an outer surface of the clamp 610. In this way, the clamps 610 and the communications node 400 become an integral tool.

The illustrative clamps 610 of FIG. 6 include two arcuate sections 612, 614. The two sections 612, 614 pivot relative to one another by means of a hinge. Hinges are shown in phantom at 615. In this way, the clamps 610 may be selectively opened and closed.

Each clamp 610 also includes a fastening mechanism 620. The fastening mechanisms 620 may be any means used for mechanically securing a ring onto a tubular body, such as a hook or a threaded connector. In the arrangement of FIG. 6, the fastening mechanism is a threaded bolt 625. The bolt 625 is received through a pair of rings 622, 624. The first ring 622 resides at an end of the first section 612 of the clamp 610, while the second ring 624 resides at an end of the second section 614 of the clamp 610. The threaded bolt 625 may be tightened by using, for example, one or more washers (not shown) and threaded nuts 627.

In operation, a clamp 610 is placed onto the tubular body 630 by pivoting the first 612 and second 614 arcuate sections of the clamp 610 into an open position. The first 612 and second 614 sections are then closed around the tubular body 630, and the bolt 625 is run through the first 622 and second 624 receiving rings. The bolt 625 is then turned relative to the nut 627 in order to tighten the clamp 610 and connected communications node 400 onto the outer surface of the tubular body 630. Where two clamps 610 are used, this process is repeated.

The tubular body 630 may be, for example, a casing string such as the illustrative casing string 160 of FIG. 1. Alternatively, the tubular body 630 may be a string of production tubing such as the tubing 240 of FIG. 2. In any instance, the wall 412 of the communications node 400 is fabricated from a steel material having a resonance frequency compatible with the resonant frequency of the tubular body 630. Stated another way, the mechanical resonance of the wall 412 is at a frequency contained within the frequency band used for telemetry.

In one aspect, the communications node 400 is about 12 to 16 inches (0.30 to 0.41 meters) in length as it resides along the tubular body 630. Specifically, the housing 410 of the communications node may be 8 to 10 inches (0.20 to 0.25 meters) in length, and each opposing shoe 500 may be 2 to 5 inches (0.05 to 0.13 meters) in length. Further, the communications node 400 may be about 1 inch in width and inch in height. The base 410 of the communications node 400 may have a concave profile that generally matches the radius of the tubular body 630.

A method for transmitting date in a wellbore is also provided herein. The method preferably employs the communications node 400 and the communications node system 600 of FIG. 6.

Figure 7:
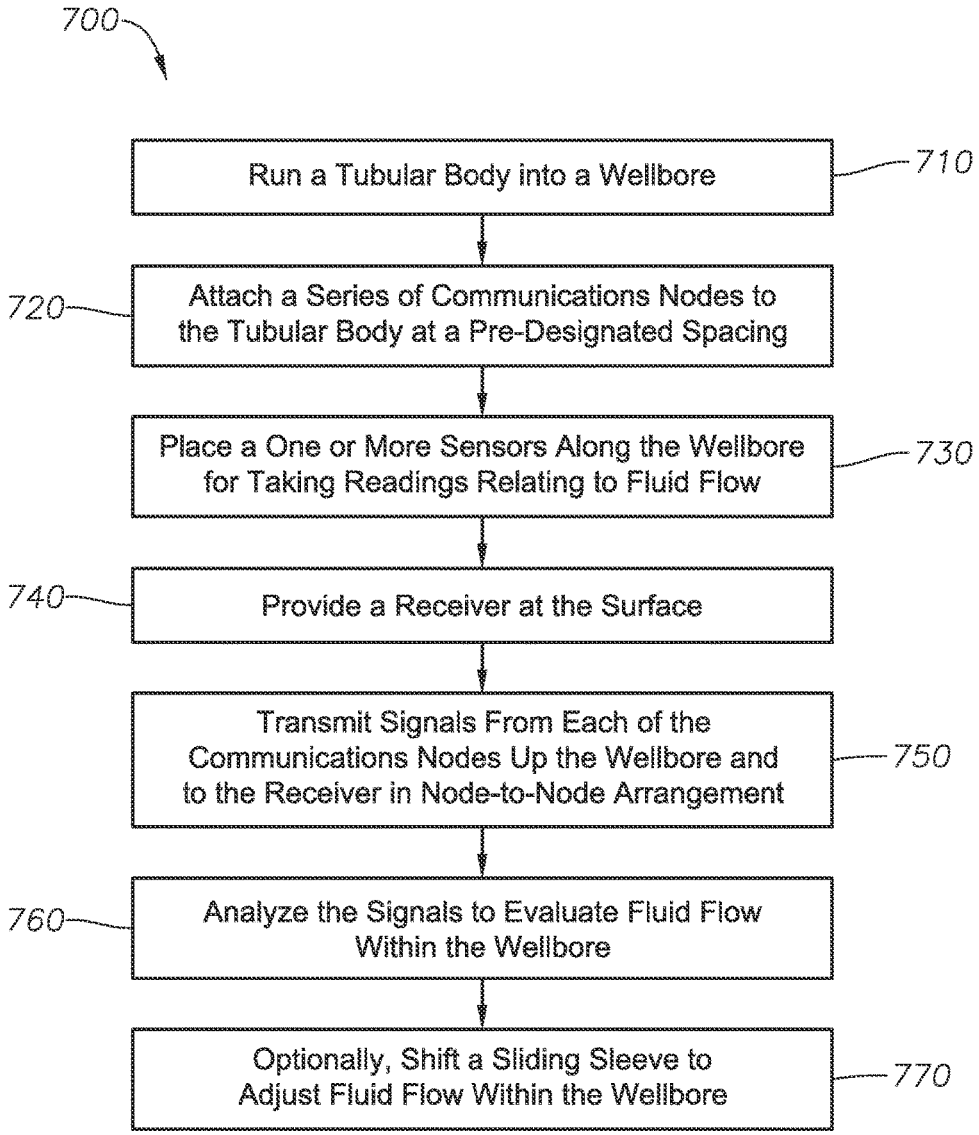
FIG. 7 is an exemplary, simplified flowchart demonstrating steps of a method for monitoring fluid flow along a wellbore in accordance with the present invention, in one embodiment.

FIG. 7 provides a flow chart for a method 700 of monitoring fluid flow within a wellbore. The method 700 uses a plurality of communications nodes situated along a casing string to accomplish a wireless transmission of data along the wellbore. The data represents signals that indicate the presence of fluid adjacent selected communications nodes.

The method 700 first includes running a tubular body into the wellbore. This is shown at Box 710. The tubular body is formed by connecting a series of pipe joints end-to-end, with the pipe joints being connected by threaded couplings. The joints of pipe are fabricated from a steel material suitable for conducting an acoustical signal.

The tubular body may be a string of production tubing. Alternatively, the tubular body may be a string of injection tubing. Alternatively still, the tubular body may be a string of casing. In this instance, the wellbore may have more than one casing string, including a string of surface casing, one or more intermediate casing strings, and a production casing. In any aspect, the wellbore is completed for the purpose of conducting hydrocarbon recovery operations.

The method 700 also provides for attaching a series of communications node to the joints of pipe. This is provided at Box 720. The communications nodes are attached according to a pre-designated spacing.

The communications nodes will include a topside communications node that is placed along the wellbore proximate the surface. This is the uppermost communications node along the wellbore. The topside communications node may be placed below grade, such as on an uppermost joint of casing or tubing, either below ground or in a cellar. Alternatively, the topside communications node may be placed above grade by connecting that node to the well head.

The communications nodes will also include a plurality of subsurface communications nodes. In one aspect, each joint of pipe receives a subsurface communications node. Preferably, each of the subsurface communications nodes is attached to a joint of pipe by one or more clamps. In this instance, the step 720 of attaching the communications nodes to the joints of pipe comprises clamping the communications nodes to an outer surface of the joints of pipe. Alternatively, an adhesive material or welding may be used for the attaching step 720.

The subsurface communications nodes are configured to transmit acoustic waves up to the topside node. Each subsurface communications node includes a transceiver that receives an acoustic signal from a previous communications node, and then transmits or relays that acoustic signal to a next communications node, in node-to-node arrangement. The topside communications node then transmits signals from an uppermost subsurface communications node to a receiver at the surface.

The method 700 also includes providing one or more sensor along the wellbore. This is shown at Box 730. The sensors are provided for taking readings relating to (or for detecting) fluid flow. The sensors may include, for example, flow measurement devices, fluid identification sensors, and temperature sensors. Selected subsurface communications nodes will either house or will be in electrical communication with a sensor. For example, three or more subsurface communications nodes will receive signals from a flow measurement device, such as a spinner. These selected subsurface communications nodes will preferably be placed along a subsurface formation where production or injection is taking place. These selected nodes are referred to as sensor communications nodes.

In addition, selected subsurface communications nodes may house (or be in electrical communication with) a fluid identification sensor. In addition, selected subsurface communications nodes may house (or be in electrical communication with) a temperature sensor. Each of these communications nodes are again referred to as sensor communications nodes.

The sensor communications nodes receive electrical signals from the sensors, and then generate an acoustic signal using an electro-acoustic transducer. The acoustic signal corresponds to readings sensed by the respective sensors. The transceivers in the subsurface communications nodes then transmit the acoustic signals up the wellbore, node-to-node.

The method 700 also includes providing a receiver. This is shown at Box 740. The receiver is placed at the surface. The receiver has a processor that processes signals received from the topside communications node, such as through the use of firmware and/or software. The receiver preferably receives electrical or optical signals via a so-called "Class I, Division I" conduit or through a radio signal. The processor processes signals to identify which signals correlate to which sensor communications node that originated the signal. In this way, the operator will understand the depth or zone at which the readings are being made.

The method next includes transmitting signals from each of the communications nodes up the wellbore and to the receiver. This is provided at Box 750. The signals are acoustic signals that have a resonance amplitude. These signals are sent up the wellbore, node-to-node. In one aspect, piezo wafers or other piezoelectric elements are used to receive and transmit acoustic signals. In another aspect, multiple stacks of piezoelectric crystals or other magnetostrictive devices are used. Signals are created by applying electrical signals of an appropriate frequency across one or more piezoelectric crystals, causing them to vibrate at a rate corresponding to the frequency of the desired acoustic signal.

In one aspect, the data transmitted between the nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. Preferably, the communication nodes determine the transmitted frequency by receiving or "listening to" the acoustic waves for a time period corresponding to the reverberation time, which is typically much longer than the transmission time. The tone duration should be long enough that the frequency spectrum of the tone burst has negligible energy at the frequencies of neighboring tones, and the listening time must be long enough for the multipath to become substantially reduced in amplitude. In one embodiment, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. Beneficially, the energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node. In this way, if one node fails, it can be bypassed by transmitting data directly between its nearest neighbors above or below. In one example, the tones are evenly spaced in period within a frequency band from about 50 kHz to 500 kHz. More preferably, the tones are evenly spaced in frequency within a frequency band from about 100 kHz to 125 kHz.

Preferably, the nodes employ a "frequency hopping" method where the last transmitted tone is not immediately re-used. This prevents extended reverberation from being mistaken for a second transmitted tone at the same frequency. For example, 17 tones are utilized for representing data in an MFSK modulation scheme; however, the last-used tone is excluded so that only 16 tones are actually available for selection at any time.

The communications nodes will transmit data as mechanical waves at a rate exceeding about 50 bps.

The method 700 also includes analyzing the signals received from the communications nodes. This is seen at Box 760. The signals are analyzed to determine the presence or nature of fluid flow. Where the sensors are fluid measurement devices, the presence or even the volume of fluid flow is measured. Where the sensors are fluid identification sensors, the nature of the fluid, e.g., oil vs. water, is learned. Where the sensors are temperature sensors, temperature data is gathered. Where the sensors are piezoelectric transducers or microphones, sound or seismic or vibrational or wave data may be gathered. Where the sensors are pressure sensors, pressure data is gathered. Pressure drop may be measured across an inflow control device downhole. For example, an orifice plate may be placed in a tubing with pressure sensors measuring the pressure differential on either side of the plate.

Changes in temperature and pressure and sound may be indicative of changes in fluid flow or phase. The communications nodes generate signals that correspond to any or all of these wellbore fluid parameters.

In one aspect, analyzing the signals means reviewing historical data as a function of wellbore depth. For example, a chart or graph showing changes in temperature or changes in pressure at a specific zone as a function of time may be provided. In another aspect, analyzing the signals means comparing sensor readings along various zones of interest. In this way, a temperature profile or a fluid identification profile or a flow volume profile along the wellbore may be created. In yet another aspect, analyzing the signals means acquiring numerical data and entering it into reservoir simulation software. The reservoir simulator may then be used to predict future pressure changes, earth subsidence (which influences hardware integrity), fluid flow trends, or other factors.

A next step in the method 700 may be the identification of a subsurface communications node that is sending signals indicative of a need for remedial action along the wellbore. This is provided at Box 770. Such signals may be signals indicative of poor fluid flow, of a loss of pressure, or of gas or water breakthrough. Accordingly, the method 700 may further include the step of actuating an inflow control device to adjust fluid flow along the wellbore. This is indicated at Box 780. The step of actuating an inflow control device may comprise sending an acoustic signal down the subsurface communications nodes and to the sensor communications nodes, where an electrical signal is then sent to the inflow control device. The inflow control device has a controller, powered by batteries, that will open or close a sleeve as desired to improve well performance.

In the method 700, each of the communications nodes has an independent power source. The independent power source may be, for example, batteries or a fuel cell. Having a power source that resides within the housing of the communications nodes reduces the need for passing electrical connections through the housing, which could compromise fluid isolation. In addition, each of the intermediate communications nodes has a transducer and associated transceiver.

Preferably, a signal may be sent from the surface to the communications nodes to switch them into a low-power, or "sleep," mode. This preserves battery life when real-time downhole data is not needed. The communications nodes may be turned back on to generate a flow profile along selected zones of the wellbore. In one aspect, the communications nodes are turned on prior to beginning an acid stimulation treatment. The sensors downhole will measure the flow rate of the stimulation fluid moving past each sensor communications node and out into the formation. In this way, real time information on the outflow profile is gathered. In a similar way, outflow data may be gathered where the wellbore is used as an injection well for water flooding or other secondary recovery operations.

A separate method for monitoring the flow of fluids in a wellbore is provided herein. The method is applicable to both production and injection wells. The method relies upon an acoustic telemetry system for transmitting signals indicative of fluid flow along portions of a wellbore.

The method first includes receiving signals from a wellbore. Each signal defines a packet of information having (i) an identifier for a subsurface communications node originally transmitting the signal, and (ii) an acoustic waveform for the subsurface communications node originally transmitting the signal. The acoustic waveform is indicative of a wellbore flow condition. The fluid flow condition is any of (i) fluid flow volume, (ii) fluid identification, (iii) pressure, (iv) temperature, or (v) combinations thereof.

The method also includes correlating communications nodes to their respective locations in the wellbore. In addition, the method comprises processing the amplitude values to evaluate fluid flow conditions in the wellbore.

In this method, the subsurface communications nodes may be constructed in accordance with communications node 350 of FIG. 3, communications node 400 of FIG. 4, or other arrangement for acoustic transmission of data. Preferably, each of the subsurface communications nodes is attached to an outer wall of the tubing or the casing string according to a pre-designated spacing. The subsurface communications nodes are configured to communicate by acoustic signals transmitted through the wall of a tubular body.

The fluid flow conditions are detected by sensors residing along a subsurface formation. The sensors may be any of fluid measurement devices, fluid identification sensors, pressure sensors, or temperature sensors. In any instance, electrical or fiber optic signals are sent from the sensors to selected subsurface communications nodes. Electro-acoustic transducers within the sensors, in turn, send acoustic signals to a transceiver, which then transmits the signals acoustically. The transceivers in the selected subsurface communications nodes transmit acoustic signals up the wellbore representative of the fluid flow readings, node-to-node.

As can be seen, a novel downhole telemetry system is provided, as well as a novel method for the wireless transmission of information using a plurality of data transmission nodes for monitoring the presence of fluid flow. The inventions improve well performance by using attachable sensors to measure flow rates and other data along the wellbore, along with downhole devices to reconfigure the completion.

Example 1

After a portion of a wellbore has been drilled, a casing crew is brought in to run casing into the wellbore. The casing crew is trained in how to install subsurface communications nodes and onto an outer wall of the joints of casing. The communications nodes are clamped onto the pipe joints during run-in and before cementing to form a wireless acoustic telemetry system. After all of the casing strings are in place and the well is completed, the communications nodes are activated. Signals are delivered from fluid flow sensors at the depth of subsurface formation to sensor communications nodes. Those nodes transmit the signals as acoustic signals via a plurality of intermediate communications nodes and a topside communications node, up to a receiver at the surface. The acoustic signals are packets of information that identify the sensor communications node sending the original waveform, and the volume and/or type of fluids flowing through or past each sensor.

While it will be apparent that the inventions herein described are well calculated to achieve the benefits and advantages set forth above, it will be appreciated that the inventions are susceptible to modification, variation and change without departing from the spirit thereof.

What is claimed is:

1. An electro-acoustic telemetry system for monitoring fluid flow in a wellbore, comprising:

a tubular body disposed in a wellbore;

a topside communications node placed proximate a surface of the wellbore;

one or more sensors along the wellbore for at least one of sensing, monitoring, and measuring a parameter indicative of fluid flow within the wellbore and generating a sensor signal representative of fluid flow data;

one or more sensor communications nodes associated with and in communication with at least one of the one or more sensors, each of the one or more sensor communications nodes configured to (i) receive a sensor signal from an associated sensor and (ii) transmit an acoustic signal indicative of the sensor signal to at least one of a plurality of subsurface communications nodes;

the plurality of subsurface communications nodes spaced along the wellbore and attached to a wall of the tubular body, each of the plurality of subsurface communications nodes configured to receive and transmit acoustic communications signals indicative of the sensor signal from node-to-node up the wellbore within the tubular body and to the topside communications node; and a receiver at the surface configured to receive signals from the topside communications node;

wherein each of the plurality of subsurface communications nodes comprises:

an electro-acoustic transducer and associated transceiver in acoustic communication with the wall of the tubular body, with the transceiver being designed to relay the acoustic communications signals from node-to-node up the wellbore using the tubular body as an acoustic transmission medium, with each of the acoustic communications signals representing a packet of information that comprises an identifier for the sensor communications node that originally transmitted the signal, and the fluid flow data; and an independent power source providing electrical power to the transceiver;

wherein adjacent nodes selected from the plurality of subsurface communications nodes represent pairs of nodes;

wherein a receiving node in the pair of nodes is configured to detect amplitude and/or reverberation time for each tone received in a packet from a transmitting node in the pair of nodes, and then return the packet to the transmitting node; and wherein the transmitting node is configured to adjust its transmitting energy or its frequency band so that a weakest tone in the packet as returned by the receiving node will be received at a weakest signal amplitude for which communication remains robust, reduce a waiting time between tones to a smallest time required for the reverberation to substantially subside, and instruct the receiving node that it has made any changes in the transmitting energy, the waiting time, or the frequency band.

2. The electro-acoustic telemetry system of claim 1, wherein the surface is an earth surface or a production platform offshore.

3. The electro-acoustic telemetry system of claim 1, wherein the tubular body is one or more strings of casing, a string of production tubing, or a string of injection tubing.

4. The electro-acoustic telemetry system of claim 1, wherein the subsurface communications nodes are spaced apart such that each joint of pipe supports at least one subsurface communications node.

5. The electro-acoustic telemetry system of claim 1, wherein the subsurface communications nodes are spaced at about 10 to 100 foot (3.0 to 30.5 meter) intervals.

6. The electro-acoustic telemetry system of claim 1, wherein each of the transceivers is designed to receive acoustic waves at a first frequency, and then transmit the acoustic waves at a second different frequency up the wellbore to a next subsurface communications node.

7. The electro-acoustic system of claim 1, further comprising:

one or more sensors placed along the wellbore, the sensors being any of fluid flow measurement devices, temperature sensors, fluid identification sensors, pressure sensors, amp meters or volt meters that measure an electrical current that is passed along a body of the subsurface communications node, an electrical device that measures a capacitance of fluid, a microphone, a device for measuring fluid density, and a device for measuring rheology of fluid density in proximity to a corresponding subsurface communications node; and wherein the subsurface communications nodes are configured to receive and relay acoustic signals indicative of readings taken by the sensors up to the surface.

8. The electro-acoustic system of claim 7, wherein:

the one or more sensors reside within housings of selected subsurface communications nodes; and the electro-acoustic transducers within the selected subsurface communications nodes convert signals from the sensors into acoustic signals for the associated transceivers.

9. The electro-acoustic system of claim 7, wherein:

the one or more sensors reside adjacent to selected subsurface communications nodes;

each of the one or more sensors is in electrical or optical communication with a corresponding selected subsurface communications node; and the electro-acoustic transducers within the selected subsurface communications nodes convert signals from the sensors into acoustic signals for the associated transceivers.

10. The electro-acoustic system of claim 7, wherein a frequency band for the acoustic wave transmission by the transceivers is about 25 KHz wide.

11. The electro-acoustic system of claim 7, wherein a frequency band for the acoustic wave transmission by the transceivers operates from about 100 kHz to 125 kHz.

12. The electro-acoustic telemetry system of claim 7, wherein the acoustic waves provide data that is modulated by (i) a multiple frequency shift keying method, (ii) a frequency shift keying method, (iii) a multi-frequency signaling method, (iv) a phase shift keying method, (v) a pulse position modulation method, or (vi) an on-off keying method.

13. The electro-acoustic telemetry system of claim 1, wherein:

a well head is placed above the wellbore; and the topside communications node is placed (i) on an outer surface of the well head, or (ii) on the outer surface of an uppermost joint of the tubular body.

14. The electro-acoustic telemetry system of claim 13, wherein the signal from the topside communications node to the receiver is transmitted via a Class I, Division I conduit or a wireless transmission.

15. The electro-acoustic telemetry system of claim 1, wherein the subsurface communications nodes are attached to the outer wall of the tubular body by (i) an adhesive material, (ii) welding, or (iii) one or more mechanical fasteners.

16. The electro-acoustic telemetry system of claim 1, wherein:

each of the subsurface communications nodes is attached to the tubular body by one or more clamps; and each of the one or more clamps comprises:

a first arcuate section;

a second arcuate section;

a hinge for pivotally connecting the first and second arcuate sections; and a fastening mechanism for securing the first and second arcuate sections around an outer surface of a pipe joint.

17. The electro-acoustic telemetry system of claim 1, wherein:

the receiver comprises a processor; and the processor is programmed to identify amplitude values generated by each subsurface communications node and convert those into numerical values for graphing or for review.

18. The electro-acoustic telemetry system of claim 1, wherein:

the one or more sensors are fluid flow measurement devices spaced along the wellbore proximate a subsurface formation, with each fluid flow measurement device being in electrical communication with a selected subsurface communications node;

the selected subsurface communications node being designed to generate acoustic signals that correspond to fluid flow measurement readings taken by the respective fluid flow measurement devices; and the fluid flow data in the acoustic waveforms comprises fluid flow measurement data.

19. The electro-acoustic telemetry system of claim 1, wherein:

the one or more sensors are temperature sensors spaced along the wellbore proximate a subsurface formation, with each temperature sensor being in electrical communication with a selected subsurface communications node;

the selected subsurface communications node being designed to generate acoustic signals that correspond to temperature readings taken by the respective temperature sensors; and the fluid flow data in the acoustic waveforms comprises temperature data.

20. The electro-acoustic telemetry system of claim 1, wherein:

the one or more sensors are pressure sensors spaced along the wellbore proximate a subsurface formation, with each pressure sensor being in electrical communication with a selected subsurface communications node;

the selected subsurface communications node being designed to generate acoustic signals that correspond to pressure readings taken by the respective pressure sensor; and the fluid flow data in the acoustic waveforms comprises pressure data.

21. The electro-acoustic telemetry system of claim 1, wherein:

the one or more sensors are fluid identification sensors spaced along the wellbore proximate a subsurface formation, with each fluid identification sensor being in electrical communication with a selected subsurface communications node;

the selected subsurface communications node being designed to generate acoustic signals that correspond to fluid identification readings taken by the respective fluid identification sensors; and the fluid flow data in the acoustic waveforms comprises fluid identification data.

22. The electro-acoustic telemetry system of claim 1, wherein each of the plurality of subsurface communications nodes receives and transmits acoustic communications signals indicative of the sensor signal from node-to-node up the wellbore within the tubular body and to the topside communications node at an acoustic transmission frequency within a range of from about 50 kHz to 500 kHz and acoustic data transmission rate of at least 50 bps.

23. A method of monitoring fluid flow along a wellbore, comprising:

running joints of a pipe into the wellbore, the joints being connected by threaded couplings to form a pipe string;

placing a topside communications node along the wellbore;

attaching a series of subsurface communications nodes to the joints of pipe according to a pre-designated spacing, wherein the subsurface communications nodes are configured to communicate by acoustic signals transmitted through the joints of pipe using an acoustic transducer in acoustic communication with at least one of the joints of pipe, and wherein each of the subsurface communications nodes comprises:

an electro-acoustic transducer and associated transceiver configured to relay signals, with each signal representing a packet of information that comprises an identifier for the subsurface communications node originally transmitting the signal and fluid flow data; and an independent power source for providing power to the transceiver;

sending signals from one or more sensors placed along the wellbore to selected sensor communications nodes, the signals being indicative of one or more fluid flow parameters;

sending acoustic signals from the sensor communications nodes to a receiver at a surface via the series of subsurface communications nodes and the topside communications node, node-to-node; and analyzing the signals to evaluate fluid flow within the wellbore;

wherein adjacent nodes of the series of subsurface communications nodes represent pairs of nodes;

wherein a receiving node in the pair of nodes is configured to detect amplitude and/or reverberation time for each tone received in a packet from a transmitting node in the pair of nodes, and then return the packet to the transmitting node; and wherein the transmitting node is configured to adjust its transmitting energy or its frequency band so that a weakest tone in the packet as returned by the receiving node will be received at a weakest signal amplitude for which communication remains robust, reduce a waiting time between tones to a smallest time required for the reverberation to substantially subside, and instruct the receiving node that it has made any changes in the transmitting energy, the waiting time, or the frequency band.

24. The method of claim 23, wherein the surface is an earth surface or production platform offshore.

25. The method of claim 23, wherein the subsurface communications nodes are spaced apart such that each joint of pipe supports at least one subsurface communications node.

26. The method of claim 23, wherein the subsurface communications nodes are spaced at about 10 to 100 foot (3.0 to 30.5 meter) intervals.

27. The method of claim 23, wherein:

the tubular body comprises one or more strings of casing, a string of production tubing, or a string of injection tubing; and each of the subsurface communications nodes includes a housing that is fabricated from a steel material, with the steel material of the housing having a resonance frequency within a width of the resonance frequency of the acoustic waves transmitted through the joints of pipe.

28. The method of claim 23, further comprising:

placing the one or more sensors along the wellbore, the sensors the sensors being any of fluid flow measurement devices, temperature sensors, fluid identification sensors, and pressure sensors; and wherein the subsurface communications nodes are configured to receive and relay acoustic signals indicative of readings taken by the sensors up to the surface.

29. The method of claim 28, wherein:

the one or more sensors reside within housings of sensor subsurface communications nodes; and the electro-acoustic transducers within the sensor communications nodes convert signals from the sensors into acoustic signals for the associated transceivers.

30. The method of claim 28, wherein:

the one or more sensors reside adjacent to housings of sensor communications nodes;

each of the one or more sensors is in electrical or optical communication with a corresponding sensor communications node; and the electro-acoustic transducers within the sensor communications nodes convert signals from the sensors into acoustic signals for the associated transceivers.

31. The method of claim 28, wherein a frequency band for the acoustic wave transmission by the transceivers is about 25 KHz wide.

32. The method of claim 28, wherein a frequency band for the acoustic wave transmission by the transceivers operates from about 100 kHz to 125 kHz.

33. The method of claim 28, wherein the acoustic waves provide data that is modulated by (i) a multiple frequency shift keying method, (ii) a frequency shift keying method, (iii) a multi-frequency signaling method, (iv) a phase shift keying method, (v) a pulse position modulation method, or (vi) an on-off keying method.

34. The method of claim 23, wherein:

a well head is placed above the wellbore; and the topside communications node is placed (i) on an outer surface of the well head, or (ii) on the outer surface of an uppermost joint of the pipe string.

35. The method of claim 34, wherein the topside communications node is in electrical communication with the receiver by means of a Class I, Division I conduit or a wireless transmission.

36. The method of claim 23, wherein each of the subsurface communications nodes is attached to an outer wall of a joint of pipe by (i) an adhesive material, (ii) welding, or (iii) one or more mechanical fasteners.

37. The method of claim 23, wherein:

each of the subsurface communications nodes is attached to a joint of pipe by one or more clamps; and the step of attaching the communications nodes to the joints of pipe comprises clamping the communications nodes to an outer surface of the joints of pipe.

38. The method of claim 37, wherein:

each of the subsurface communications nodes includes a housing that comprises a first end and a second opposite end; and each of the one or more clamps comprises a first clamp secured at the first end of the housing, and a second clamp secured at the second end of the housing.

39. The method of claim 23, wherein:

the one or more sensors are fluid flow measurement devices spaced along the wellbore proximate a subsurface formation, with each fluid flow measurement device being in electrical communication with a selected subsurface communications node;

the selected subsurface communications node being designed to generate acoustic signals that correspond to fluid flow measurement readings taken by the respective fluid flow measurement devices; and the fluid flow data in the acoustic waveforms comprises fluid flow measurement data.

40. The method of claim 23, wherein:

the one or more sensors are temperature sensors spaced along the wellbore proximate a subsurface formation, with each temperature sensor being in electrical communication with a selected subsurface communications node;

the selected subsurface communications node being designed to generate acoustic signals that correspond to temperature readings taken by the respective temperature sensors; and the fluid flow data in the acoustic waveforms comprises temperature data.

41. The method of claim 23, wherein:

the one or more sensors are pressure sensors spaced along the wellbore proximate a subsurface formation, with each pressure sensor being in electrical communication with a selected subsurface communications node;

the selected subsurface communications node being designed to generate acoustic signals that correspond to pressure readings taken by the respective pressure sensor; and the fluid flow data in the acoustic waveforms comprises pressure data.

42. The method of claim 23, wherein:

the one or more sensors are fluid identification sensors spaced along the wellbore proximate a subsurface formation, with each fluid identification sensor being in electrical communication with a sensor communications node;

the sensor communications node being designed to generate acoustic signals that correspond to fluid identification readings taken by the respective fluid identification sensors; and the fluid flow data in the acoustic waveforms comprises fluid identification data.

43. The method of claim 23, further comprising:

identifying a sensor communications node sending signals indicative of a need for remedial action; and actuating an inflow control device proximate the sensor communications node to adjust fluid flow into or out of the wellbore.

44. The method of claim 43, wherein the need for remedial action is prompted by water breakthrough, gas break through, or a loss of pressure.

45. The method of claim 43, wherein the step of actuating an inflow control device comprises sending an acoustic signal down the subsurface communications nodes and to the sensor communications nodes, where an electrical signal is then sent to the inflow control device.

46. The method of claim 23, wherein the subsurface communications nodes communicate by acoustic signals transmitted through the joints of pipe within a range of from about 50 kHz to 500 kHz and acoustic data transmission rate of at least 50 bps.

* * * * *